US010309088B2

(12) United States Patent
Yaoka et al.

(10) Patent No.: US 10,309,088 B2
(45) Date of Patent: Jun. 4, 2019

(54) URINAL APPARATUS AND URINAL UNIT

(71) Applicant: TOTO, Ltd., Kitakyushu-shi, Fukuoka (JP)

(72) Inventors: Toshinari Yaoka, Kitakyushu (JP); Yoichi Murase, Kitakyushu (JP)

(73) Assignee: TOTO, Ltd., Kitakyushu-shi, Fukuoka (JP)

( * ) Notice: Subject to any disclaimer, the term of this patent is extended or adjusted under 35 U.S.C. 154(b) by 172 days.

(21) Appl. No.: 14/806,715

(22) Filed: Jul. 23, 2015

(65) Prior Publication Data

US 2016/0024777 A1 Jan. 28, 2016

(30) Foreign Application Priority Data

Jul. 23, 2014 (JP) ..... 2014-149751
Jul. 23, 2014 (JP) ..... 2014-149752
Jul. 23, 2014 (JP) ..... 2014-149753

(51) Int. Cl.
*E03D 13/00* (2006.01)

(52) U.S. Cl.
CPC ..... *E03D 13/00* (2013.01)

(58) Field of Classification Search
CPC . E03D 13/00; E03D 13/005; E03D 2009/028; E03D 9/002; E03D 9/005; E03D 2009/024–028; E03D 5/105
USPC ..... 4/223–227.1, 301, 309, 443–448, 302
See application file for complete search history.

(56) References Cited

U.S. PATENT DOCUMENTS 3,774,246 A * 11/1973 Beer ..... C02F 1/4602 204/229.5
6,319,390 B1 * 11/2001 Kono ..... A61L 2/035 204/228.2
6,862,754 B1 * 3/2005 DeMarco ..... E03D 13/00 4/302
7,051,381 B2 * 5/2006 Furukawa ..... A47K 13/10 4/246.1
7,304,569 B2 * 12/2007 Marcichow ..... E03C 1/057 340/3.1
8,434,172 B2 * 5/2013 Nowak ..... E03D 5/105 251/129.04

(Continued)

FOREIGN PATENT DOCUMENTS

CN 201176632 Y 1/2009
EP 1029991 A2 8/2000

(Continued)

OTHER PUBLICATIONS

Nov. 9, 2015—(SG) Invitation to Respond to Written Opinion—App 10201505749Y.

*Primary Examiner* — David P Angwin
*Assistant Examiner* — Nicholas A Ros
(74) *Attorney, Agent, or Firm* — Banner & Witcoff, Ltd.

(57) ABSTRACT

There is provided a urinal apparatus including: a water supplying device configured to supply water to a bowl section of a urinal; a water sprinkling device including a sprinkling hole configured to sprinkle water to a space inside the bowl section; and a human body sensing device configured to sense use of the urinal. The water sprinkling device not sprinkling the water from the sprinkling hole when the human body sensing device has transitioned from a human body non-sensing state to a human body sensing state.

23 Claims, 17 Drawing Sheets

(56) References Cited

U.S. PATENT DOCUMENTS

| | | | | |
|---|---|---|---|---|
| 2006/0064805 | A1* | 3/2006 | Yamamoto | E03D 9/05 4/213 |
| 2007/0245474 | A1* | 10/2007 | Nakladal | E03D 13/005 4/309 |
| 2009/0249533 | A1* | 10/2009 | Sawalski | E03D 9/005 4/223 |
| 2010/0031430 | A1* | 2/2010 | Chang | E03D 5/10 4/302 |
| 2010/0064425 | A1 | 3/2010 | Ito | |
| 2012/0228532 | A1* | 9/2012 | Oberholzer | E03D 1/012 251/129.01 |
| 2013/0105403 | A1* | 5/2013 | Chen | E04H 4/1281 210/739 |
| 2014/0059757 | A1 | 3/2014 | Hamakita et al. | |
| 2014/0352048 | A1* | 12/2014 | Nakamura | E03D 5/105 4/309 |

FOREIGN PATENT DOCUMENTS

| | | | | |
|---|---|---|---|---|
| EP | 2657415 | A1 | 10/2013 | |
| JP | H07-207741 | * | 8/1995 | E03D 13/00 |
| JP | H07-207741 | A | 8/1995 | |
| JP | H08-39068 | A | 2/1996 | |
| JP | H09-144103 | A | 6/1997 | |
| JP | H10-37269 | A | 2/1998 | |
| JP | H11-169858 | A | 6/1999 | |
| JP | 2005-290673 | A | 10/2005 | |
| JP | 2005-290696 | A | 10/2005 | |
| JP | 2006-097240 | A | 4/2006 | |
| JP | 2006097240 | * | 4/2006 | E03D 9/02 |
| JP | 2007090178 | * | 4/2007 | E03C 1/10 |
| JP | 2008-240375 | A | 10/2008 | |
| JP | 2008-291472 | A | 12/2008 | |
| JP | 2013-087580 | A | 5/2013 | |
| JP | 2013-155523 | A | 8/2013 | |
| WO | 2012/133298 | A1 | 10/2012 | |

* cited by examiner

URINAL APPARATUS AND URINAL UNIT

CROSS-REFERENCE TO RELATED APPLICATIONS

This application is based upon and claims the benefit of priorities from Japanese Patent Application No. 2014-149751, filed on Jul. 23, 2014, Japanese Patent Application No. 2014-149752, filed on Jul. 23, 2014, and Japanese Patent Application No. 2014-149753, filed on Jul. 23, 2014; the entire contents of which are incorporated herein by reference.

FIELD

Embodiments described herein relate generally to a urinal apparatus and a urinal unit.

BACKGROUND

The bowl section of a urinal may be flushed with water in order to flush foreign matter such as urine and hair attached to the bowl surface and to replace the seal water in the trap by newly supplied water. Passing water in the bowl section of the urinal for the purpose of flushing foreign matter and replacing seal water requires passing a large amount of water along the bowl surface. The water flowing along the bowl surface is less likely to splash out of the bowl section. The user standing before the urinal during bowl flush is rarely wetted. The flush sound at the time of bowl flush is small.

However, the odor of the urinal may fail to be sufficiently removed by only flushing the bowl section of the urinal with water. Thus, several deodorization techniques for removing the odor of the urinal have been proposed. One of such deodorization techniques is a urinal in which water does not flow down along the vertical surface of the toilet bowl, but is directly squirted from a water jetting hole through a water supply pipe (Patent Literature 1 (Japanese Unexamined Utility Model Application Publication No. S62-94173)). In the urinal disclosed in Patent Literature 1, water is sprinkled to the space in the bowl section of the urinal.

Water is sprinkled to the space in the bowl section of the urinal through e.g. the sprinkling hole of a sprinkling device. The flow velocity of water significantly changes near the sprinkling hole by pressure increase of water and pressure release in the space. The water is sprinkled at a fixed pressure from the sprinkling hole having a small diameter. Thus, the flow velocity of water significantly changes near the sprinkling hole. The change of flow velocity of water may induce what is called a shower sound, or a drop sound when the droplet of water is brought into contact with the bowl section.

In the urinal disclosed in Patent Literature 1, water may be sprinkled before or during the act of urination of the user of the urinal apparatus. Then, the user may hear a shower sound or drop sound. This causes a problem of giving discomfort to the user. For instance, before the act of urination, the user may stop approaching the urinal apparatus and abort the act intended for urination. Alternatively, during urination, the user may miss the target, and urine may be splashed out of the bowl section.

The water supplied to the urinal may utilize tap water suitable for drinking. On the other hand, the supplied water may utilize miscellaneous water originating from used tap water (sewage), or miscellaneous water originating from rain water. The water quality management of miscellaneous water (e.g., "graywater") may be minimized compared with tap water. Thus, miscellaneous water may contain a relatively large amount of organic substances. If miscellaneous water contains a large amount of organic substances, bacteria and microorganisms nourished by the organic substances may multiply and produce an aggregation in conjunction with products therefrom. The aggregation of bacteria and microorganisms in conjunction with products therefrom is called e.g. biofilm.

For instance, when miscellaneous water is sprinkled in the urinal disclosed in Patent Literature 1, the water jetting hole may be clogged by the production of biofilm. When the water jetting hole is clogged, the sprinkled water may have an unstable direction and fail to be sprinkled to a desired space. This causes a problem of decreased level of suppressing odor generated from the urinal and soil generated in the urinal.

SUMMARY

According to an aspect of the present invention, a urinal apparatus includes: a water supplying configured to supply water to a bowl section of a urinal; a water sprinkling device including a sprinkling hole configured to sprinkle water to a space inside the bowl section; and a human body sensing device configured to sense use of the urinal, the water sprinkling device not sprinkling the water from the sprinkling hole when the human body sensing device has transitioned from a human body non-sensing state to a human body sensing state.

DETAILED DESCRIPTION

Figure 1:
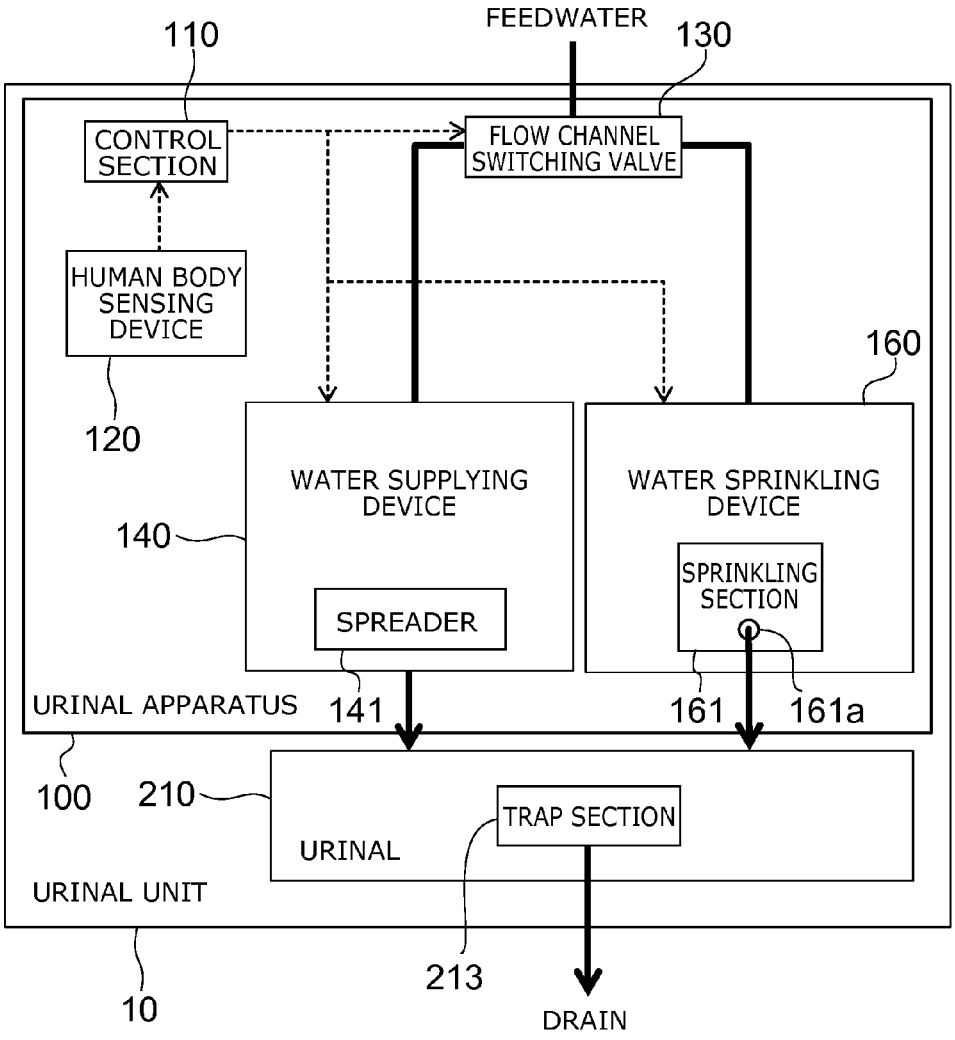
FIG. 1 is a block diagram showing the main configuration of a urinal apparatus and a urinal unit according to an embodiment of the invention.

A first aspect of the invention is a urinal apparatus comprising a water supplying device configured to supply water to a bowl section of a urinal, a water sprinkling device including a sprinkling hole configured to sprinkle water to a space inside the bowl section, and a human body sensing device configured to sense use of the urinal. The water sprinkling device does not sprinkle the water from the sprinkling hole when the human body sensing device has transitioned from a human body non-sensing state to a human body sensing state.

This urinal apparatus can suppress discomfort to the user, such as stopping approaching the urinal apparatus and aborting the act intended for urination before and during the act of urination, or missing the target and splashing urine out of the bowl section during urination.

A second aspect of the invention is a urinal apparatus according to the first aspect, wherein the water sprinkling device sprinkles the water to the space after the human body sensing device transitions from the human body sensing state to the human body non-sensing state and the water supplying device supplies the water to the bowl section.

In this urinal apparatus, the water sprinkling device sprinkles fresh water from the sprinkling hole to the bowl section after the user terminates the act of urination. Thus, the odor of the internal space of the bowl section can be deodorized. This can suppress that a subsequent user feels discomfort by the odor of the internal space of the bowl section.

A third aspect of the invention is a urinal apparatus according to the first aspect, wherein the water sprinkling device sprinkles the water from the sprinkling hole at a fixed cycle.

Activation of bacteria in urine remaining in the trap piping of the urinal takes a prescribed time. Activation of bacteria soils the trap of the urinal, causes accumulation of urinary calculus, and generates odor from the trap piping. However, this urinal apparatus can maintain the state in which urine from the trap piping is diluted with water below a certain concentration. This can suppress odor from the trap piping.

A fourth aspect of the invention is a urinal apparatus according to the first aspect, further comprising a sterilizing water producing device provided on upstream side of the water sprinkling device and configured to produce sterilizing water. The water sprinkling device sprinkles droplets of the sterilizing water produced by the sterilizing water producing device to the space inside the bowl section.

This urinal apparatus sterilizes bacteria. When the sprinkled water is dried, the concentration of ammonia dissolved in the water increases, and the odor may be generated again. However, this urinal apparatus can suppress such generation of odor. This can provide a urinal apparatus in which the odor is suppressed with a small amount of water for a long time.

A fifth aspect of the invention is a urinal apparatus according to the first aspect, wherein the water supplying device includes a hole configured to sprinkle water to the bowl section. The amount of water sprinkled to the bowl section in one operation by the water supplying device is larger than the amount of water sprinkled to the space in one operation by the water sprinkling device.

This urinal apparatus can save water relative to conventional bowl flush, and can sprinkle a larger amount of water than the flushing of the water sprinkling device. Thus, hair that cannot be removed by the water sprinkling device can be flushed to the trap.

A sixth aspect of the invention is a urinal apparatus according to the fifth aspect, wherein the apparatus can perform a facility protecting flush operation for supplying water to the bowl section at a fixed cycle. The amount of the water supplied to the bowl section in one operation of the facility protecting flush operation is larger than the amount of water sprinkled to the bowl section in one operation by the water supplying device or the amount of water sprinkled to the space in one operation by the water sprinkling device.

A seventh aspect of the invention is a urinal apparatus according to the fourth aspect, wherein the sterilizing water producing device is actuated when the water sprinkling device is actuated, and deactuated when the water sprinkling device is deactuated.

This urinal apparatus can sterilize bacteria and microorganisms contained in miscellaneous water and suppress production of biofilm on the upstream of the water sprinkling device. Furthermore, the sterilizing water produced in the sterilizing water producing device does not continue to stay e.g. inside the sterilizing water producing device and in the flow channel located on the downstream side of the sterilizing water producing device. This can suppress clogging of the sprinkling hole of the water sprinkling device due to production of biofilm. Furthermore, this urinal apparatus can suppress sprinkling of water in an unintended direction from the water sprinkling device.

An eighth aspect of the invention is a urinal apparatus according to the fourth aspect, wherein the sterilizing water remaining after being produced by the sterilizing water producing device is drained at fixed intervals.

This urinal apparatus can sterilize bacteria and microorganisms contained in miscellaneous water and suppress production of biofilm on the upstream of the water sprinkling device. Furthermore, for instance, sprinkling flush performed at fixed intervals renews the water in the flow channel at fixed intervals. Thus, the sterilizing water produced in the sterilizing water producing device does not continue to stay e.g. inside the sterilizing water producing device and in the flow channel located on the downstream side of the sterilizing water producing device. Furthermore, activation of bacteria is suppressed, and bacteria can be minimized. This can suppress clogging of the sprinkling hole of the water sprinkling device due to production of biofilm. Furthermore, this urinal apparatus can suppress sprinkling of water in an unintended direction from the water sprinkling device.

A ninth aspect of the invention is a urinal apparatus according to the seventh or eighth aspect, wherein amount of water supplied to the bowl section in one operation by the water supplying device is larger than amount of water sprinkled to the space in one operation by the water sprinkling device. The water supplied by the water supplying device is fresh water excluding the sterilizing water.

In this urinal apparatus, sterilizing water is not used as the water supplied by the water supplying device. Thus, a sterilizing water producing device dedicated to the water sprinkling device can be provided. This can improve the degree of freedom of the design of the urinal apparatus.

Furthermore, the amount of water supplied to the bowl section in one operation by the water supplying device is larger than the amount of water sprinkled to the internal space of the bowl section in one operation by the water sprinkling device. Thus, if sterilizing water is used as the water supplied by the water supplying device, the sterilizing water producing device is upsized. Furthermore, the lifetime of the sterilizing water producing device is shorter in the case where sterilizing water is used as the water supplied by the water supplying device than in the case where sterilizing water is not used as the water supplied by the water supplying device. This requires regular maintenance.

In contrast, this urinal apparatus can suppress upsizing of the sterilizing water producing device, shortening of the lifetime of the sterilizing water producing device, and requirement of regular maintenance.

A tenth aspect of the invention is a urinal apparatus according to the seventh or eighth aspect, further comprising a flow channel communicating the sterilizing water producing device with the water sprinkling device. Sterilizing water in the flow channel is drained a prescribed time after the water sprinkling device is deactuated.

In this urinal apparatus, the sterilizing water with decreased sterilization effect does not continue to stay in the flow channel. This can suppress clogging of the sprinkling hole of the water sprinkling device due to production of biofilm. Furthermore, this urinal apparatus can suppress sprinkling of water in an unintended direction from the water sprinkling device.

An eleventh aspect of the invention is a urinal apparatus according to the seventh or eighth aspect, further comprising a flow channel communicating the sterilizing water producing device with the water sprinkling device. Sterilizing water in the flow channel is drained from a drain hole different from the sprinkling hole after the water sprinkling device is actuated.

In this urinal apparatus, the sterilizing water with decreased sterilization effect does not continue to stay in the flow channel. This can suppress clogging of the sprinkling hole of the water sprinkling device due to production of biofilm. Furthermore, this urinal apparatus can suppress sprinkling of water in an unintended direction from the water sprinkling device.

A twelfth aspect of the invention is a urinal apparatus according to the fourth aspect, wherein the sprinkling operation of the water sprinkling device is prohibited when it is determined that the sterilizing water producing device is faulty.

In this urinal apparatus, the sprinkling operation of the water sprinkling device is prohibited when it is determined that the sterilizing water producing device is faulty. This can suppress sprinkling of water other than sterilizing water in an unintended direction from the water sprinkling device.

A thirteenth aspect of the invention is a urinal apparatus according to the twelfth aspect, wherein the sterilizing water producing device includes an electrolytic bath and an electrode provided inside the electrolytic bath. It is determined that the sterilizing water producing device is faulty when voltage applied to the electrode is less than or equal to a prescribed value.

In this urinal apparatus, the fault of the sterilizing water producing device can be sensed more easily.

A fourteenth aspect of the invention is a urinal apparatus according to the twelfth aspect, wherein the sterilizing water producing device includes an electrolytic bath and an electrode provided inside the electrolytic bath. It is determined that the sterilizing water producing device is faulty when current flowing in the electrode is less than or equal to a prescribed value.

In this urinal apparatus, the fault of the sterilizing water producing device can be sensed more easily.

A fifteenth aspect of the invention is a urinal apparatus according to the twelfth aspect, wherein the sterilizing water producing device includes an electrolytic bath and an electrode provided inside the electrolytic bath. It is determined that the sterilizing water producing device is faulty when energization time of the electrode is more than or equal to a prescribed value.

In this urinal apparatus, the fault of the sterilizing water producing device can be sensed more easily.

A sixteenth aspect of the invention is a urinal apparatus according to the fifteenth aspect, wherein voltage applied to the electrode is increased when the energization time is less than the prescribed value and reaches another prescribed value less than and different from the prescribed value.

In this urinal apparatus, the voltage applied to the electrode is increased while the electrode of the sterilizing water producing device is degraded and the production concentration of the sterilizing water is decreased. This can maintain the production concentration of the sterilizing water at a generally fixed level.

A seventeenth aspect of the invention is a urinal apparatus according to the twelfth aspect, wherein the sterilizing water producing device includes an electrolytic bath. It is determined that the sterilizing water producing device is faulty when integrated amount of water flowing in the electrolytic bath is more than or equal to a prescribed value.

In this urinal apparatus, the fault of the sterilizing water producing device can be sensed more easily.

An eighteenth aspect of the invention is a urinal apparatus according to the seventeenth aspect, wherein the sterilizing water producing device further includes an electrode provided inside the electrolytic bath. The voltage applied to the electrode is increased when the integrated amount of water is less than the prescribed value and reaches another prescribed value less than and different from the prescribed value.

In this urinal apparatus, the voltage applied to the electrode is increased while the electrode of the sterilizing water producing device is degraded and the production concentration of the sterilizing water is decreased. This can maintain the production concentration of the sterilizing water at a generally fixed level.

A nineteenth aspect of the invention is a urinal apparatus according to the twelfth aspect, wherein the sterilizing water producing device includes an electrolytic bath. It is determined that the sterilizing water producing device is faulty when flow rate of water flowing in the electrolytic bath is less than or equal to a prescribed value.

In this urinal apparatus, the fault of the sterilizing water producing device can be sensed more easily.

A twentieth aspect of the invention is a urinal unit comprising a urinal and the urinal apparatus according to the first aspect.

This urinal unit can sterilize bacteria and microorganisms contained in miscellaneous water and suppress production of biofilm on the upstream of the water sprinkling device. This can suppress clogging of the sprinkling hole of the water sprinkling device due to production of biofilm. Furthermore, this urinal unit can suppress sprinkling of water in an unintended direction from the water sprinkling device.

Embodiments of the invention will now be described with reference to the drawings. In the drawings, similar components are labeled with like reference numerals, and the detailed description thereof is omitted appropriately.

FIG. 1 is a block diagram showing the main configuration of a urinal apparatus and a urinal unit according to an embodiment of the invention.

In FIG. 1, the main configurations of the water channel system and the electrical system are shown in combination.

The urinal unit 10 according to this embodiment includes a urinal apparatus 100 and a urinal 210. The urinal apparatus 100 includes a water supplying device 140 and a water sprinkling device 160. The urinal apparatus 100 according to this embodiment may include a control section 110, a human body sensing device 120, and a flow channel switching valve 130.

The urinal 210 is a male urinal. The urinal 210 includes a bowl section 211 (see FIGS. 8A and 8B) and a trap section 213 (see FIG. 8B). The trap section 213 is provided in the lower part of the bowl section 211. The trap section 213 forms seal water inside the trap section 213 itself. Thus, the trap section 213 can prevent e.g. foul odors and pests from intruding into e.g. the toilet room from e.g. the horizontal drain piping, not shown, provided behind the urinal apparatus 100. Urine and water flow into the trap section 213.

The flow channel switching valve 130 is switched between the following two states based on the signal transmitted from the control section 110. In the first state, water (this water is referred to as "fresh water") supplied from the feedwater source (such as waterworks and tank), not shown, is guided to the water supplying device 140. In the second state, water supplied from the feedwater source is guided to the water sprinkling device 160.

The fresh water is tap water or miscellaneous water supplied from the feedwater source. Instead of providing the flow channel switching valve 130, water may be supplied from different feedwater sources to the water supplying device 140 and the water sprinkling device 160.

The water supplying device 140 includes a spreader 141. By the water supplying device 140, water supplied from the feedwater source through the flow channel switching valve 130 is supplied to the bowl section 211 of the urinal 210.

The water sprinkling device 160 includes a sprinkling section 161. The sprinkling section 161 includes a sprinkling hole 161*a*. The number of sprinkling holes 161*a* is not limited to one as shown in FIG. 1. The water sprinkling device 160 supplies fresh water droplets from the sprinkling hole 161*a* of the sprinkling section 161 to the internal space of the bowl section 211 of the urinal 210. The diameter of the fresh water droplets sprinkled by the water sprinkling device 160 is e.g. approximately 10 micrometers (μm) or more and 1200 μm or less.

The amount of water supplied to the bowl section 211 in one operation by the water supplying device 140 is larger than the amount of water supplied to the bowl section 211 in one operation by the water sprinkling device 160. For instance, the amount of water supplied to the bowl section 211 in one operation by the water supplying device 140 is approximately 0.4 liters (L) or more and 1.5 L or less. For instance, the amount of water supplied to the bowl section 211 in one operation by the water sprinkling device 160 is e.g. approximately 20 milliliters (mL) or more and 100 mL or less.

The water supplying device 140 may have a flushing mode of sprinkling fresh water droplets like the water sprinkling device 160. For instance, the water supplying device 140 includes a hole for sprinkling water to the bowl section 211. In this case, the sprinkling range of the water supplying device 140 is a range of sprinkling water toward the bowl surface of the bowl section 211. This can save water relative to conventional bowl flush, and can sprinkle a larger amount of water than the flushing of the water sprinkling device 160. Thus, hair that cannot be removed by the water sprinkling device 160 can be flushed to the trap section 213.

The human body sensing device 120 can sense a user located before the urinal 210, i.e., a user located at a position spaced before the urinal 210. In other words, the human body sensing device 120 can sense the use of the urinal 210. Upon sensing the use of the urinal 210, the human body sensing device 120 transitions from a human body non-sensing state to a human body sensing state. Such a human body sensing device 120 can be e.g. an infrared transmit/receive sensor (infrared sensor), a pyroelectric sensor, or a sensor based on the Doppler effect of radio waves (microwave sensor). Here, in this specification, the "human body non-sensing state" includes not only the state in which the human body sensing device 120 senses no human body. The "human body non-sensing state" also includes the state in which the human body sensing device 120 determines that the state is non-sensing because the human body sensed by the human body sensing device 120 is spaced by a prescribed distance or more.

When the human body sensing device 120 senses a user located at a position spaced before the urinal 210, the water sprinkling device 160 does not sprinkle fresh water droplets from the sprinkling hole 161*a*. For instance, when the human body sensing device 120 senses the use of the urinal 210, the control section 110 controls the water sprinkling device 160 so as to prohibit the sprinkling operation of the water sprinkling device 160 based on the sensing of the human body sensing device 120.

Here, water is sprinkled to the space in the bowl section of the urinal through the sprinkling hole of the water sprinkling device. In this case, water is sprinkled at a fixed pressure from the sprinkling hole having a small diameter. Thus, the flow velocity significantly changes near the sprinkling hole by pressure increase of water and pressure release in the space. Because water is sprinkled at a fixed pressure from the sprinkling hole having a small diameter, the change of flow velocity induces what is called a shower sound, or a drop sound when the droplet of water is brought into contact with the bowl section.

When water is sprinkled in the urinal, the user of the urinal apparatus may hear a shower sound or drop sound before or during the act of urination. This gives discomfort to the user. For instance, before or during the act of urination, the user may stop approaching the urinal apparatus and abort the act intended for urination. Alternatively, during urination, the user may miss the target, and urine may be splashed out of the bowl section.

In contrast, in the case of sensing a user located at a position spaced before the urinal 210, the water sprinkling device 160 of this embodiment does not sprinkle fresh water droplets from the sprinkling hole 161*a*. This can suppress discomfort to the user.

The water supplying device 140 can supply water to the bowl section 211 of the urinal 210, remove urine attached to the urinal 210, and remove foreign matter such as hair. Furthermore, the water supplying device 140 can supply water to the trap section 213 of the urinal 210 and replace seal water inside the trap section 213 by newly supplied water.

As described above, the diameter of the water droplets sprinkled by the water sprinkling device 160 is approximately 10 μm or more. Thus, the droplets sprinkled from the water sprinkling device 160 remain suspended in the space to a lesser extent. Accordingly, splashing to any unintended space can be suppressed. This can suppress that the droplets sprinkled from the water sprinkling device 160 we the user and the surroundings of the urinal 210. Furthermore, the diameter of the water droplets sprinkled by the water sprinkling device 160 is approximately 1200 μm or less. This can suppress decreasing the effect of dissolving ammonia because the droplets sprinkled from the water sprinkling device 160 fall relatively fast.

Here, the definition of the numerical value of the diameter of a water particle is described. The diameter of the water particle sprinkled from the water sprinkling device 160 has a certain range in general. The particle diameter of the point at which the distribution curve of the cumulative percentage of the particle diameter crosses the horizontal axis of 50% is referred to as 50% diameter (generally referred to as median diameter). The 50% diameter is used as the diameter of the water particle.

In the urinal apparatus 100 according to this embodiment, the bowl section 211 may be supplied with fresh water at a fixed cycle. The urinal apparatus 100 may include a device for performing facility protecting flushing. This can flush the drain pipe disposed downstream of the urinal 210. Furthermore, urine remaining in the trap section 213 after the operation of the water supplying device 140 and the water sprinkling device 160 can be replaced by fresh water. The total amount of water can be saved by changing the flushing mode and amount in accordance with the purpose.

In the case of performing facility protecting flushing, the amount of the water supplied to the bowl section 211 in one operation is larger than the amount of water supplied to the bowl section 211 in one operation by the water supplying device 140 or the amount of water sprinkled to the space in one operation by the water sprinkling device 160.

Figure 2:
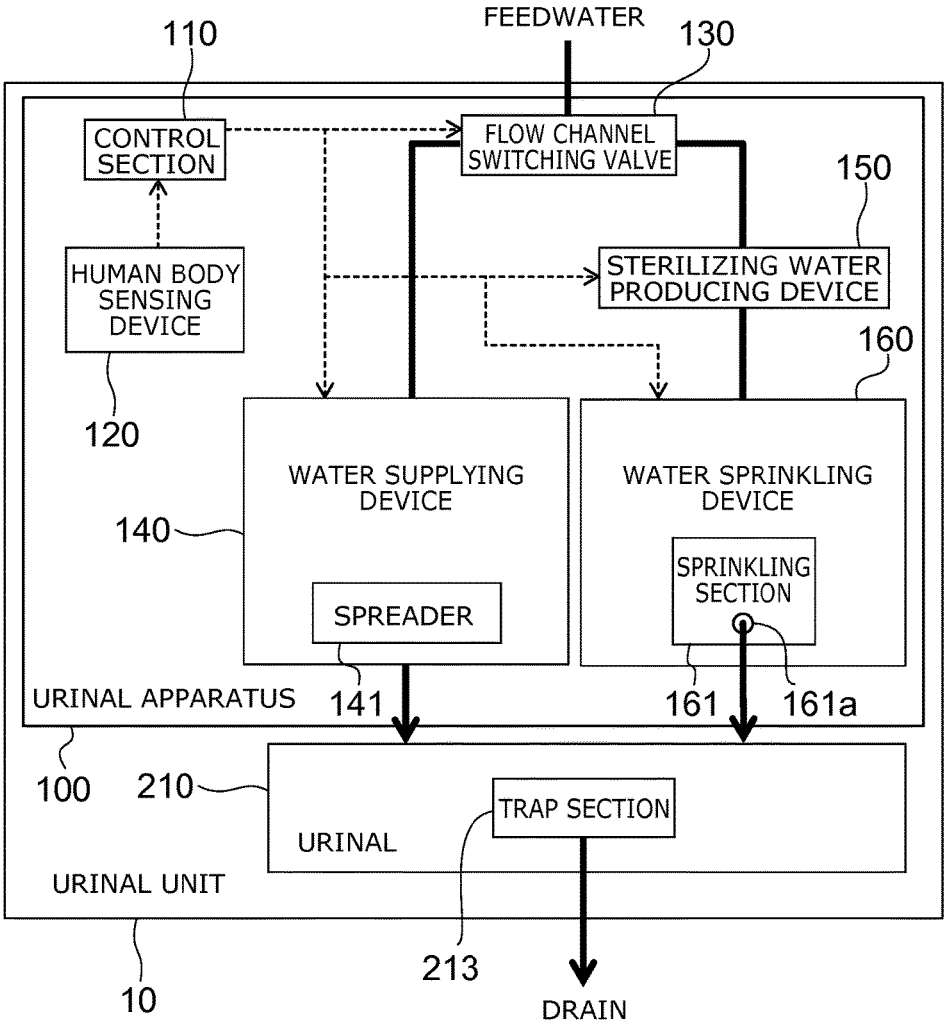
FIG. 2 is a block diagram showing the main configuration of a urinal apparatus and a urinal unit according to a variation of this embodiment.

FIG. 2 is a block diagram showing the main configuration of a urinal apparatus and a urinal unit according to a variation of this embodiment.

In FIG. 2, the main configurations of the water channel system and the electrical system are shown in combination.

In this variation, a sterilizing water producing device 150 is provided on the upstream side of the water sprinkling device 160. More specifically, the sterilizing water producing device 150 is provided between the flow channel switching valve 130 and the water sprinkling device 160.

As shown in FIG. 2, the water supplied from the feedwater source to the water supplying device 140 does not pass through the sterilizing water producing device 150. Thus, the water supplying device 140 supplies the bowl section 211 of the urinal 210 with water (fresh water) supplied from the feedwater source and not being sterilizing water. That is, sterilizing water is not used as water supplied to the bowl section 211 by the water supplying device 140.

The sterilizing water producing device 150 can produce sterilizing water from the water supplied from the feedwater source through the flow channel switching valve 130 based on the signal transmitted from the control section 110. The sterilizing water can dissolve and decompose ammonia. Ammonia is generated by e.g. urination of a user (see FIG. 16).

Figure 7:
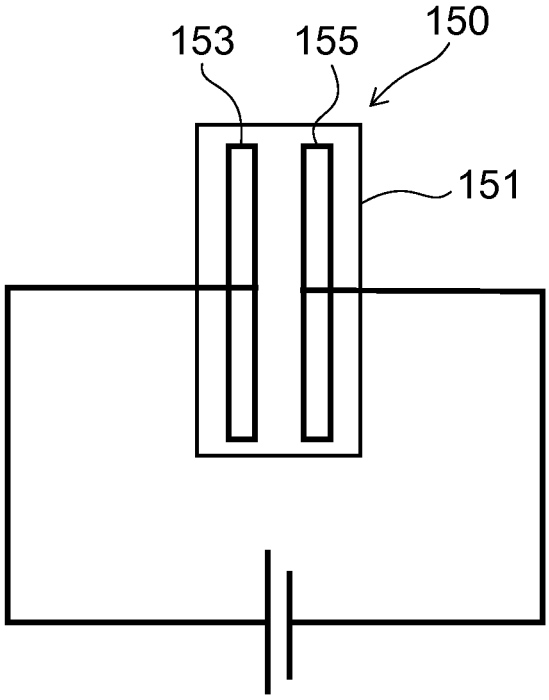
FIG. 7 is a schematic plan view illustrating a specific example of the sterilizing water producing device of this embodiment.

For instance, the sterilizing water producing device 150 includes an electrolytic bath 151 (see FIG. 7). An anode plate 153 (see FIG. 7) and a cathode plate 155 (see FIG. 7) are provided inside the electrolytic bath 151. The sterilizing water producing device 150 can electrolyze tap water or miscellaneous water flowing inside the electrolytic bath 151 based on the signal transmitted from the control section 110. Here, tap water contains chloride ions. Chloride ions are contained as e.g. salt (NaCl) and calcium chloride ($CaCl_2$) in the water source (such as groundwater, water in dams, and water in e.g. rivers). Thus, hypochlorous acid is generated by electrolyzing chloride ions. As a result, the water electrolyzed in the sterilizing water producing device 150 (electrolyzed water) is turned into a liquid containing hypochlorous acid (sterilizing water).

Hypochlorous acid functions as a deodorant component or a sterilizing component. The liquid containing hypochlorous acid can dissolve and decompose ammonia, or sterilize common bacteria.

The sterilizing water producing device 150 of this embodiment is not limited to producing a liquid containing hypochlorous acid. The sterilizing water produced in the sterilizing water producing device 150 may be a liquid containing metal ions such as silver ions and copper ions. Alternatively, the sterilizing water produced in the sterilizing water producing device 150 may be a liquid containing e.g. electrolyzed chlorine or ozone. Alternatively, the sterilizing water produced in the sterilizing water producing device 150 may be acidic water or alkaline water. Among them, the liquid containing hypochlorous acid can dissolve and decompose ammonia. Furthermore, the sterilizing water producing device 150 is not limited to an electrolytic bath unit including an electrolytic bath, an anode plate, and a cathode plate.

The sterilizing water producing device 150 produces sterilizing water based on the signal transmitted from the control section 110. Then, the water sprinkling device 160 supplies droplets of the sterilizing water produced in the sterilizing water producing device 150 from the sprinkling hole 161*a* to the internal space of the bowl section 211. That is, a prescribed amount of sterilizing water is produced by the sterilizing water producing device 150 and supplied to the bowl section 211 by the water sprinkling device 160. The diameter of the sterilizing water droplets sprinkled by the water sprinkling device 160 is e.g. approximately 10 micrometers (μm) or more and 1200 μm or less.

The sterilizing water sprinkled from the water sprinkling device 160 dissolves and decomposes at least one of ammonia produced inside the bowl section 211 and ammonia existing around the bowl section 211. The ammonia existing around the bowl section 211 refers to e.g. ammonia drifting around the bowl section 211 or ammonia suspended around the bowl section 211. Thus, the water sprinkling device 160 can suppress the odor of ammonia generated from the urinal 210. Furthermore, when the water sprinkling device 160 sprinkles sterilizing water, the water sprinkling device 160 can suppress regeneration of the odor of ammonia even if e.g. water dissolved with ammonia is attached to and evaporated from the surroundings of the urinal 210.

Furthermore, sterilizing water droplets sprinkled by the sprinkling section 161 can suppress the odor of ammonia near the ammonia source located on the surface of the bowl section 211. In addition, the droplets passing through the space can also suppress the odor of ammonia existing in the space. Furthermore, the surface area of water per unit amount of water can be made significantly larger in the water droplets than in the state of water supplied from the water supplying device 140 and moving on the surface of the bowl section 211. This can increase the area of sterilizing water in contact with ammonia to efficiently suppress the odor. The odor existing in the space includes not only that of ammonia originating from urine, but also the odor of urine itself urinated by the user (e.g., the odor derived from ingested food such as a coffee odor). The latter odor can also be suppressed by sprinkling sterilizing water droplets.

The rest of the structure of the urinal apparatus 100 and the urinal unit 10 according to this variation is similar to the structure of the urinal apparatus 100 and the urinal unit 10 described above with reference to FIG. 1.

According to this variation and the embodiment described above with reference to FIG. 1, the water sprinkling device 160 supplies droplets of the sterilizing water produced in the sterilizing water producing device 150 from the sprinkling hole 161*a* to the internal space of the bowl section 211. This can suppress the odor of ammonia generated from the urinal 210. Thus, the urinal apparatus 100 can suppress generation of odor with a small amount of water for a long time.

As described above with reference to FIG. 1, the amount of water supplied in one operation by the water supplying device 140 is larger than the amount of water supplied in one operation by the water sprinkling device 160. Thus, if sterilizing water is used as the water supplied by the water supplying device 140, the sterilizing water producing device 150 is upsized. Furthermore, the lifetime of the sterilizing water producing device 150 is shorter in the case where sterilizing water is used as the water supplied by the water supplying device 140 than in the case where sterilizing water is not used as the water supplied by the water supplying device 140. This requires regular maintenance. In contrast, this variation and the embodiment described above with reference to FIG. 1 can suppress upsizing of the sterilizing water producing device 150, shortening of the lifetime of the sterilizing water producing device 150, and requirement of regular maintenance.

The water supplied from the feedwater source may utilize tap water suitable for drinking. On the other hand, the supplied water may utilize miscellaneous water originating from used tap water (sewage), or miscellaneous water originating from rain water. The water quality management of miscellaneous water (e.g., "graywater") may be minimized compared with tap water. Thus, miscellaneous water may contain a relatively large amount of organic substances. If miscellaneous water contains a large amount of organic substances, bacteria and microorganisms nourished by the organic substances may multiply and produce an aggregation. The aggregation of bacteria and microorganisms is called e.g. biofilm.

Furthermore, the sterilizing water may not be sprinkled from the sprinkling hole 161*a* and stay as residual water in the flow channel (e.g., flow channel 150*a*) located on the downstream side of the sterilizing water producing device 150. When such residual water stays in the flow channel for a certain period, the sterilizing performance of the sterilizing water decreases by temporal change. This multiplies bacteria and microorganisms from the residual water and produces biofilm.

With the increase of the size of biofilm, the sprinkling hole 161*a* of the sprinkling section 161 may be clogged by the production of biofilm. The diameter of the sprinkling hole 161*a* is e.g. approximately 0.5 millimeters (mm) or more and 3 mm or less. A specific example of the sprinkling section 161 will be described later. When the sprinkling hole 161*a* is clogged by the production of biofilm, the sterilizing water sprinkled from the sprinkling hole 161*a* may have an unstable direction and fail to be sprinkled to the internal space of the bowl section 211. This decreases the level of suppressing odor generated from the urinal 210 and soil generated in the urinal 210.

In contrast, the water sprinkling device 160 of this embodiment sprinkles droplets of the sterilizing water produced in the sterilizing water producing device 150 from the sprinkling hole 161*a* to the internal space of the bowl section 211. This can sterilize bacteria and microorganisms contained in the miscellaneous water and suppress the production of biofilm on the upstream of the water sprinkling device 160. Furthermore, a prescribed amount of sterilizing water is produced by the sterilizing water producing device 150 and supplied to the bowl section 211 by the water sprinkling device 160. Thus, the sterilizing water produced by the sterilizing water producing device 150 can be made less likely to continue to stay in the flow channel located on the downstream side of the sterilizing water producing device 150. This can suppress clogging of the sprinkling hole 161*a* of the water sprinkling device 160 due to production of biofilm. Furthermore, this can suppress sprinkling of water in an unintended direction from the water sprinkling device 160.

Even if the human body sensing device 120 does not sense the use of the urinal 210, the water sprinkling device 160 may perform sprinkling flush at fixed intervals. For instance, the control section 110 controls the operation of the sterilizing water producing device 150 and the water sprinkling device 160 at fixed intervals. Thus, sterilizing water is produced in the sterilizing water producing device 150 and supplied from the sprinkling hole 161*a* of the sprinkling section 161 to the bowl section 211.

Here, the fixed interval (i.e., the interval of sprinkling flush) is an arbitrary time such as approximately two hours or approximately one day. As described above, activation of bacteria in urine takes a prescribed time. For instance, sprinkling flush at intervals less than two hours can suppress the increase of pH and suppress activation of bacteria.

Sprinkling flush performed at fixed intervals renews the water in the flow channel at fixed intervals. Thus, the sterilizing water produced in the sterilizing water producing device 150 does not continue to stay e.g. inside the sterilizing water producing device 150 and in the flow channel located on the downstream side of the sterilizing water producing device 150. Furthermore, activation of bacteria is suppressed, and bacteria can be minimized. This can suppress clogging of the sprinkling hole 161*a* of the water sprinkling device 160 due to production of biofilm. Furthermore, this can suppress sprinkling of water in an unintended direction from the water sprinkling device 160.

When the water sprinkling device 160 performs sprinkling flush at fixed intervals, bowl flush may be performed simultaneously. For instance, when the water sprinkling device 160 performs sprinkling flush, the control section 110 controls the operation of the water supplying device 140 to supply water from the spreader 141 of the water supplying device 140 to the bowl section 211. This can suppress that e.g. the flow channel near the flow channel switching valve 130 located on the upstream side of the sterilizing water producing device 150 is clogged by production of biofilm.

Figure 3:
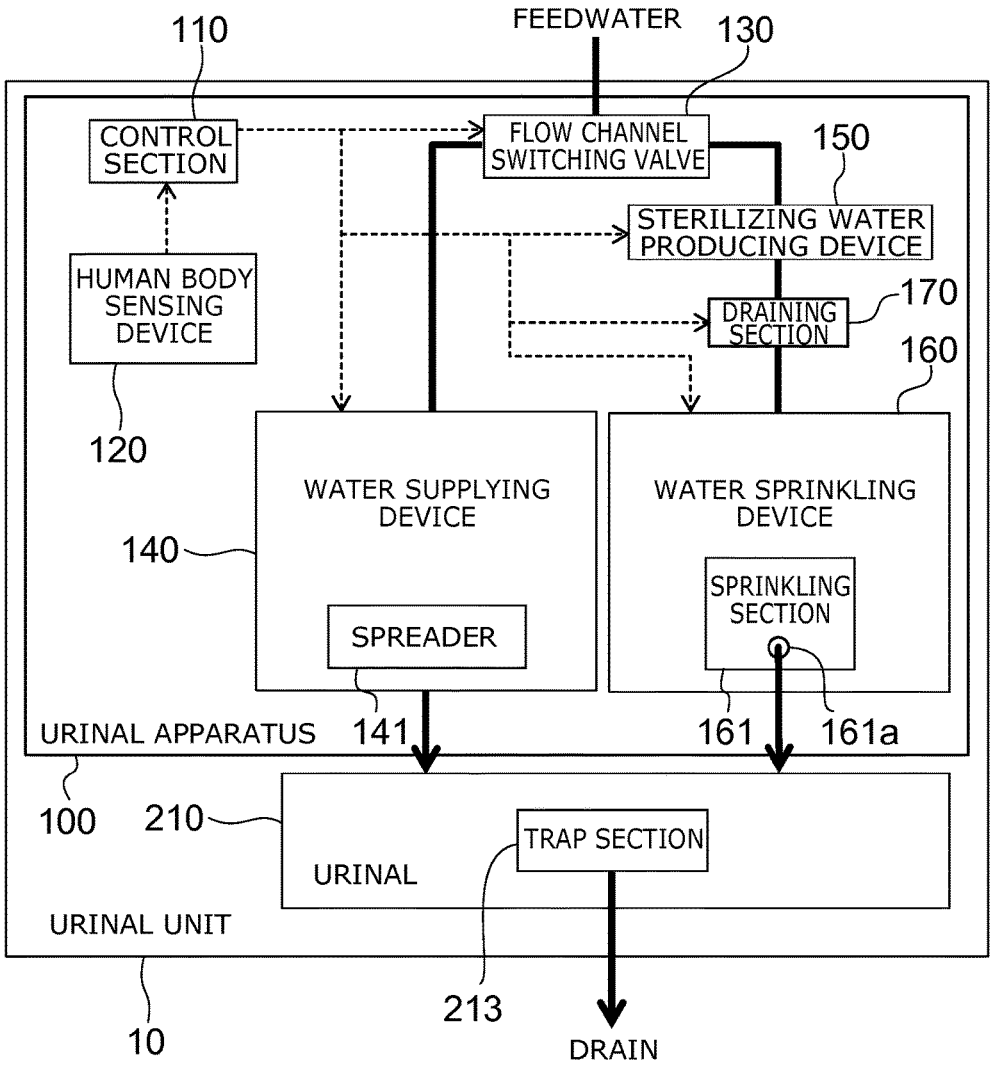
FIG. 3 is a block diagram showing the main configuration of a urinal apparatus and a urinal unit according to a variation of this embodiment.

FIG. 3 is a block diagram showing the main configuration of a urinal apparatus and a urinal unit according to a variation of this embodiment.

In FIG. 3, the main configurations of the water channel system and the electrical system are shown in combination.

In this variation, the urinal apparatus 100 includes a draining section 170. The draining section 170 is provided between the sterilizing water producing device 150 and the water sprinkling device 160. For instance, sterilizing water may remain in the flow channel communicating the sterilizing water producing device 150 with the water sprinkling device 160. The draining section 170 drains this sterilizing water from the urinal apparatus 100 based on the signal transmitted from the control section 110. The draining section 170 drains the sterilizing water at fixed intervals based on the signal transmitted from the control section 110.

When the draining section 170 is actuated, the water sprinkling device 160 is not supplied with e.g. sterilizing water. That is, when the draining section 170 is actuated, the water sprinkling device 160 does not perform sprinkling flush. For instance, the sterilizing water remaining in the flow channel is drained a prescribed time after the water sprinkling device 160 is deactuated.

In this variation, when sterilizing water remains in the flow channel located on the downstream side of the sterilizing water producing device 150, the sterilizing water remaining in the flow channel is drained at fixed intervals from the urinal apparatus 100 by the draining section 170. Thus, the sterilizing water produced in the sterilizing water producing device 150 does not continue to stay in the flow channel located on the downstream side of the sterilizing water producing device 150. This can suppress clogging of the sprinkling hole 161*a* of the water sprinkling device 160 due to production of biofilm. Furthermore, this can suppress sprinkling of water in an unintended direction from the water sprinkling device 160.

The rest of the structure of the urinal apparatus 100 and the urinal unit 10 according to this variation is similar to the structure of the urinal apparatus 100 and the urinal unit 10 described above with reference to FIG. 2.

Figure 4:
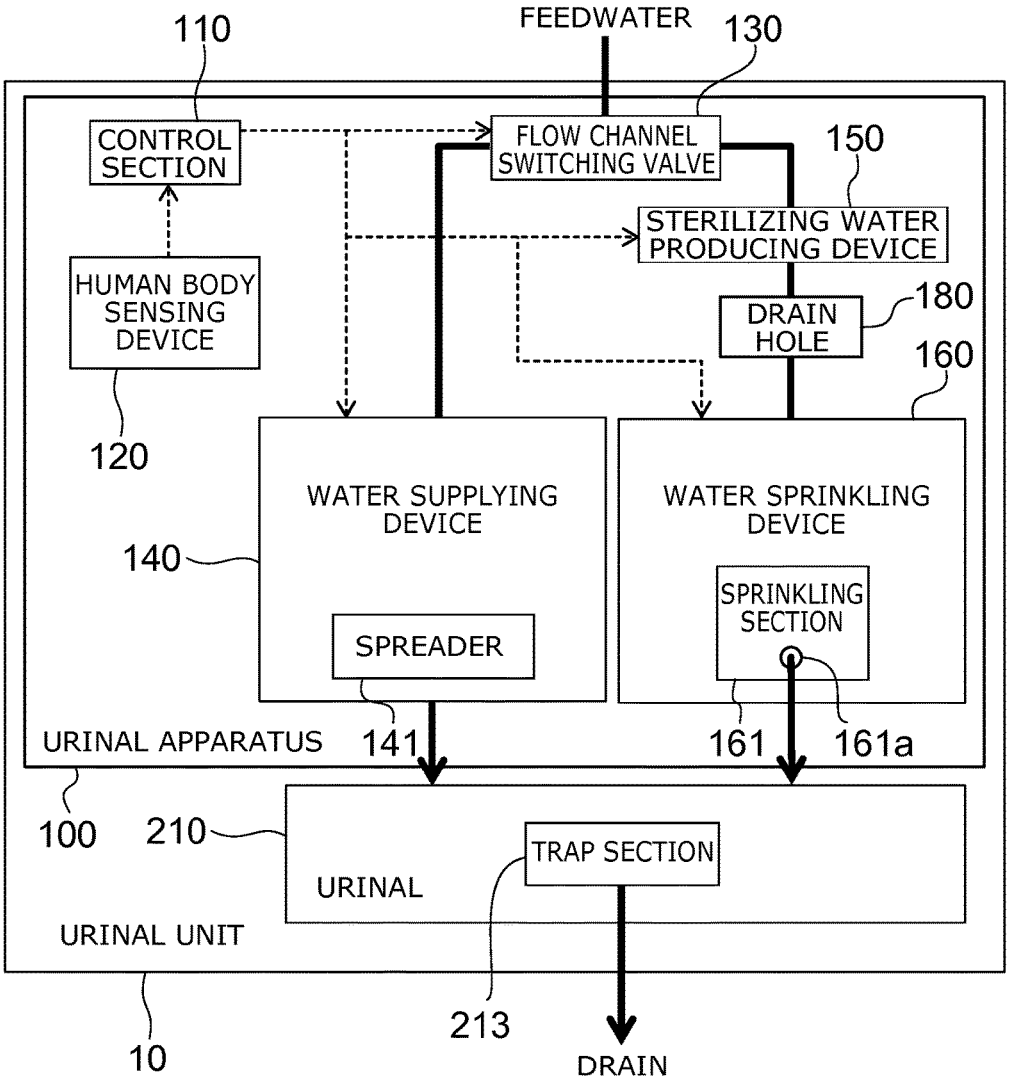
FIG. 4 is a block diagram showing the main configuration of a urinal apparatus and a urinal unit according to a variation of this embodiment.

FIG. 4 is a block diagram showing the main configuration of a urinal apparatus and a urinal unit according to a variation of this embodiment.

In FIG. 4, the main configurations of the water channel system and the electrical system are shown in combination.

In this variation, the urinal apparatus 100 includes a drain hole 180. The drain hole 180 is provided between the sterilizing water producing device 150 and the water sprinkling device 160. Sterilizing water remaining in the flow channel communicating the sterilizing water producing device 150 with the water sprinkling device 160 is drained from the urinal apparatus 100 through the drain hole 180. For instance, the water sprinkling device 160 is actuated, and sterilizing water is produced by the sterilizing water producing device 150. Before the water sprinkling device 160 sprinkles the sterilizing water through the sprinkling hole 161*a*, the sterilizing water remaining in the flow channel is drained from the urinal apparatus 100 through the drain hole 180. In this variation, the residual water staying in the flow channel located on the downstream side of the sterilizing water producing device 150 is not sprinkled from the sprinkling hole 161*a*.

When the residual water is drained through the drain hole 180, the water sprinkling device 160 is not supplied with e.g. sterilizing water. That is, when the residual water is drained through the drain hole 180, the water sprinkling device 160 does not perform sprinkling flush.

The rest of the structure of the urinal apparatus 100 and the urinal unit 10 according to this variation is similar to the structure of the urinal apparatus 100 and the urinal unit 10 described above with reference to FIG. 2.

Before the water sprinkling device 160 sprinkles sterilizing water, residual water may stay in the flow channel located on the downstream side of the sterilizing water producing device 150. According to this variation and the embodiment described above with reference to FIG. 2, the residual water is not sprinkled from the sprinkling hole 161*a*. This can suppress clogging of the sprinkling hole 161*a* with biofilm produced from the residual water. Furthermore, this can suppress sprinkling of water in an unintended direction from the water sprinkling device 160.

Figure 5:
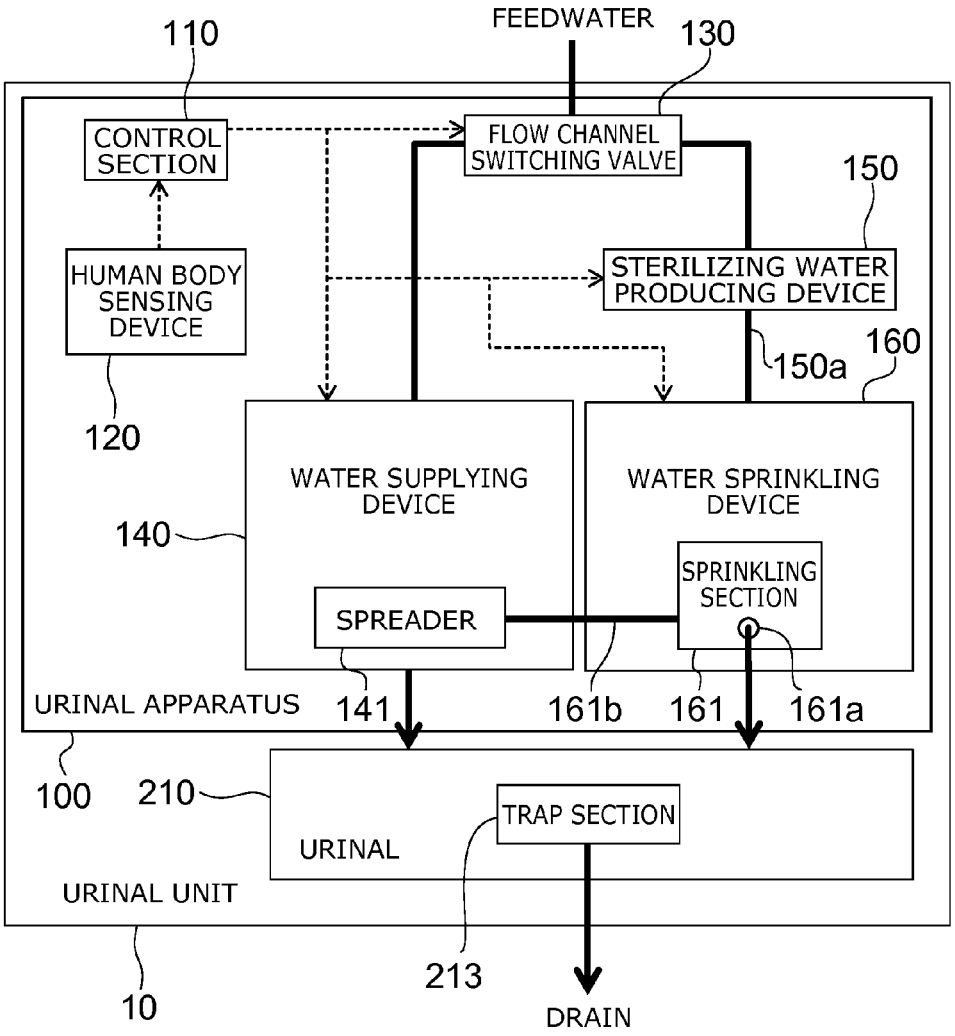
FIG. 5 is a block diagram showing the main configuration of a urinal apparatus and a urinal unit according to a variation of this embodiment.

FIG. 5 is a block diagram showing the main configuration of a urinal apparatus and a urinal unit according to a variation of this embodiment.

In FIG. 5, the main configurations of the water channel system and the electrical system are shown in combination.

In this variation, a flow channel 161*b* is provided between the sprinkling section 161 and the spreader 141. The spreader 141 includes a jetting port 145 (see FIGS. 9B and 9C). The water sprinkling device 160 is actuated, and sterilizing water is produced by the sterilizing water producing device 150. Before the water sprinkling device 160 sprinkles the sterilizing water through the sprinkling hole 161*a*, the residual water remaining in the flow channel (e.g., 150*a*) located on the downstream side of the sterilizing water producing device 150 is drained from the jetting port 145 of the spreader 141 through the flow channel 161*b*. That is, in this variation, the residual water staying in the flow channel located on the downstream side of the sterilizing water producing device 150 is not sprinkled from the sprinkling hole 161*a*.

When the residual water is drained through the jetting port 145, the water sprinkling device 160 is not supplied with e.g. sterilizing water. That is, when the residual water is drained through the jetting port 145, the water sprinkling device 160 does not perform sprinkling flush.

The rest of the structure of the urinal apparatus 100 and the urinal unit 10 according to this variation is similar to the structure of the urinal apparatus 100 and the urinal unit 10 described above with reference to FIG. 2.

Before the water sprinkling device 160 sprinkles sterilizing water, residual water may stay in the flow channel located on the downstream side of the sterilizing water producing device 150. According to this variation and the embodiment described above with reference to FIG. 2, the residual water is not sprinkled from the sprinkling hole 161*a*. This can suppress clogging of the sprinkling hole 161*a* with biofilm produced from the residual water. Furthermore, this can suppress sprinkling of water in an unintended direction from the water sprinkling device 160.

Figure 6:
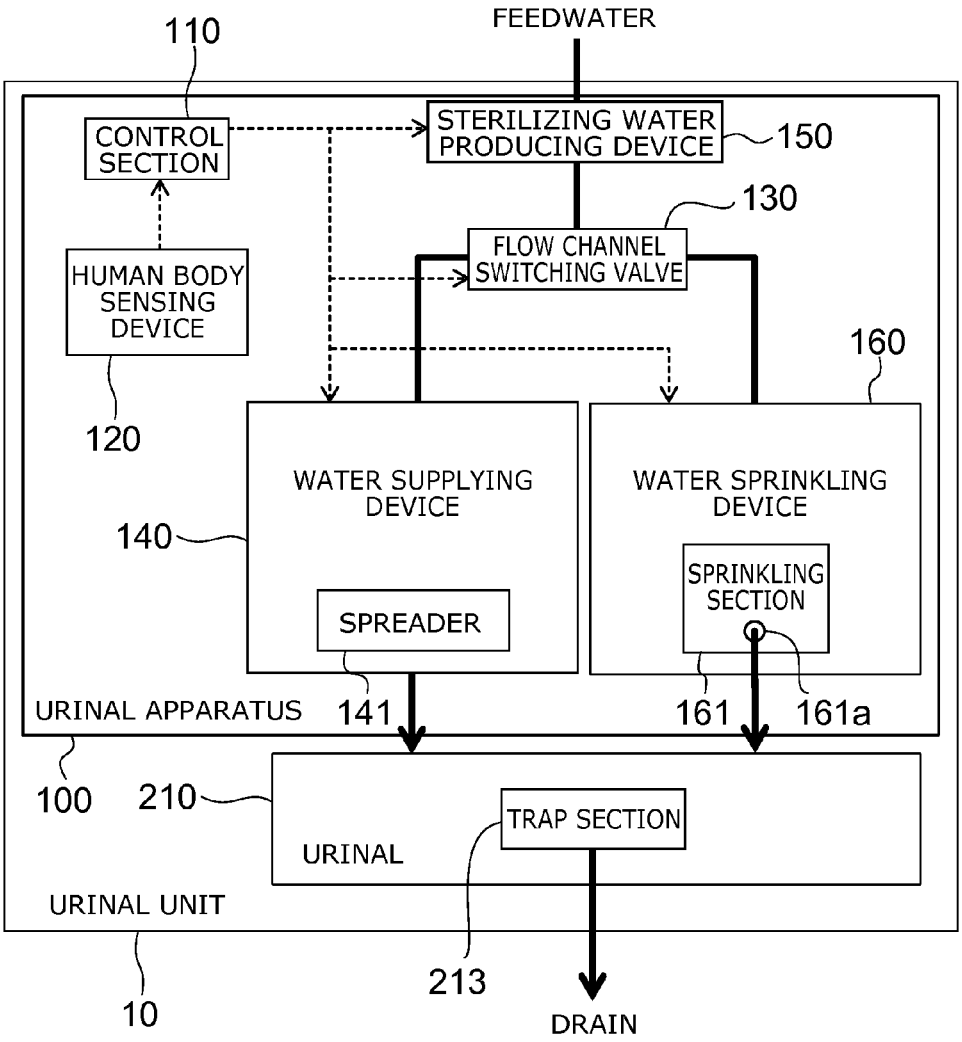
FIG. 6 is a block diagram showing the main configuration of a urinal apparatus and a urinal unit according to a variation of this embodiment.

FIG. 6 is a block diagram showing the main configuration of a urinal apparatus and a urinal unit according to a variation of this embodiment.

In FIG. 6, the main configurations of the water channel system and the electrical system are shown in combination.

In this variation, a sterilizing water producing device 150 is provided on the upstream side of the flow channel switching valve 130. More specifically, the flow channel switching valve 130 is provided between the sterilizing water producing device 150 and the water sprinkling device 160.

When the water sprinkling device 160 sprinkles sterilizing water from the sprinkling hole 161*a*, the sterilizing water producing device 150 produces sterilizing water based on the signal transmitted from the control section 110. The flow channel switching valve 130 is set to the state in which water is guided to the water sprinkling device 160 based on the signal transmitted from the control section 110. The sterilizing water produced in the sterilizing water producing device 150 is guided to the water sprinkling device 160 through the flow channel switching valve 130.

On the other hand, when the water supplying device 140 supplies water from the spreader 141, the sterilizing water producing device 150 stops production of sterilizing water based on the signal transmitted from the control section 110. That is, in this variation, as in the embodiment described above with reference to FIG. 2, sterilizing water is not used as water supplied to the bowl section 211 by the water supplying device 140. The flow channel switching valve 130 is set to the state in which water is guided to the water supplying device 140 based on the signal transmitted from the control section 110. Water is supplied from the feedwater source in the state in which the sterilizing water producing device 150 does not produce sterilizing water. This water (fresh water) is guided to the water supplying device 140 through the flow channel switching valve 130.

The rest of the structure of the urinal apparatus 100 and the urinal unit 10 according to this variation is similar to the structure of the urinal apparatus 100 and the urinal unit 10 described above with reference to FIG. 2.

According to this variation and the embodiment described above with reference to FIG. 2, sterilizing water is not used as the water supplied by the water supplying device 140. Thus, a sterilizing water producing device 150 dedicated to the water sprinkling device 160 can be provided. This can improve the degree of freedom of the design of the urinal apparatus 100 and the urinal unit 10.

As described above with reference to FIG. 2, the amount of water supplied in one operation by the water supplying device 140 is larger than the amount of water supplied in one operation by the water sprinkling device 160. Thus, if sterilizing water is used as the water supplied by the water supplying device 140, the sterilizing water producing device 150 is upsized. Furthermore, the lifetime of the sterilizing water producing device 150 is shorter in the case where sterilizing water is used as the water supplied by the water supplying device 140 than in the case where sterilizing water is not used as the water supplied by the water supplying device 140. This requires regular maintenance. In contrast, this variation and the embodiment described above with reference to FIG. 2 can suppress upsizing of the sterilizing water producing device 150, shortening of the lifetime of the sterilizing water producing device 150, and requirement of regular maintenance.

FIG. 7 is a schematic plan view illustrating a specific example of the sterilizing water producing device of this embodiment.

In this specific example, the sterilizing water producing device 150 includes an electrolytic bath 151, an anode plate 153, and a cathode plate 155. The anode plate 153 and the cathode plate 155 are provided inside the electrolytic bath 151.

When the sterilizing water producing device 150 produces sterilizing water, a prescribed voltage (e.g., approximately 24 volts (V)) is applied between the anode plate 153 and the cathode plate 155. According to the knowledge obtained by the inventor, the voltage applied between the anode plate 153 and the cathode plate 155 is maintained at the prescribed voltage despite degradation of at least one of the anode plate 153 and the cathode plate 155.

Figure 8A:
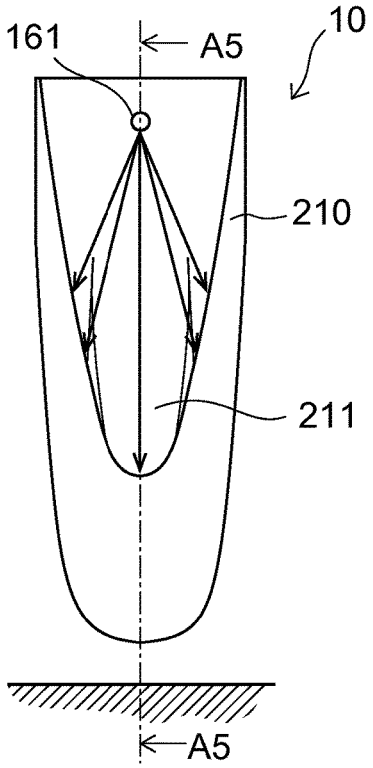
FIGS. 8A and 8B are schematic perspective views illustrating an installation mode of the water sprinkling device of this embodiment.
Figure 8B:
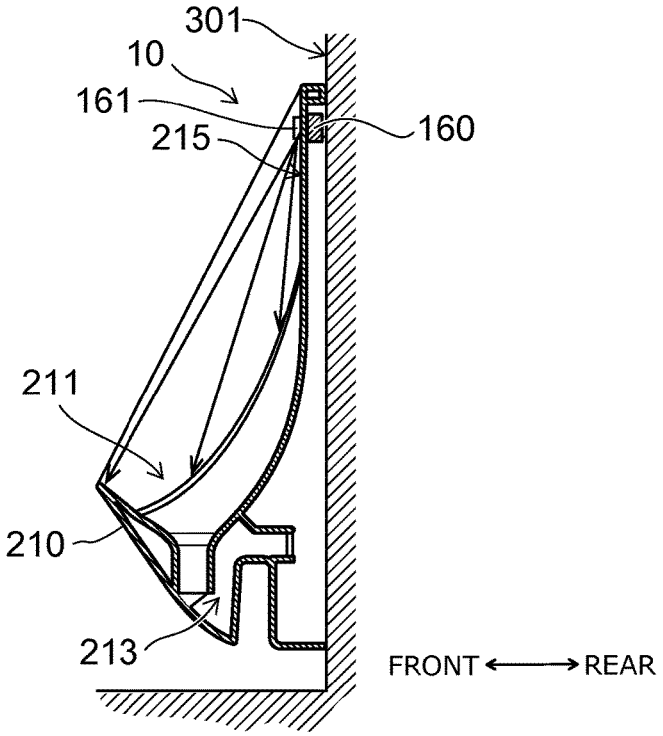

FIGS. 8A and 8B are schematic perspective views illustrating an installation mode of the water sprinkling device of this embodiment.

FIG. 8A is a schematic plan view showing the urinal unit according to this embodiment. FIG. 8B is a schematic sectional view at cross section A5-A5 shown in FIG. 8A.

As shown in FIGS. 8A and 8B, for instance, the sprinkling section 161 of the water sprinkling device 160 is provided in an upper part of the bowl section 211 of the urinal 210. The sprinkling section 161 sprinkles droplets of fresh water or sterilizing water downward to the bowl section 211. The term "downward" used herein is not limited to the vertical downward direction, but includes directions below the horizontal direction. That is, the term "downward" used herein refers to a direction except the horizontal direction and the directions above the horizontal direction.

Thus, the sprinkling section 161 sprinkles droplets of fresh water or sterilizing water downward from the upper part of the bowl section 211. This generates an air flow directed downward from the sprinkling section 161 inside the bowl section 211. Thus, the air flow generated inside the bowl section 211 can suppress updraft of ammonia. Furthermore, the sterilizing water sprinkled from the sprinkling section 161 dissolves ammonia, and decomposes ammonia into odorless substances. This makes the user less likely to feel the odor of ammonia generated from the urinal apparatus 100.

The installation mode of the water sprinkling device 160 is not limited to the example shown in FIGS. 8A and 8B. For instance, the sprinkling section 161 of the water sprinkling device 160 may be provided in a lower part of the bowl section 211 of the urinal 210. In this case, the sprinkling section 161 sprinkles water droplets upward to the bowl section 211. The term "upward" used herein is not limited to the vertical upward direction, but includes directions above the horizontal direction. That is, the term "upward" used herein refers to a direction except the horizontal direction and the directions below the horizontal direction.

Thus, the sprinkling section 161 sprinkles sterilizing water droplets upward from the lower part of the bowl section 211. Accordingly, at least part of the sterilizing water sprinkled from the sprinkling section 161 can drift outside the bowl section 211. The water drifting outside the bowl section 211 can dissolve ammonia gas existing outside the bowl section 211. This makes the user less likely to feel the odor around the urinal 210 as well as the odor of the urinal 210.

Figure 9A:
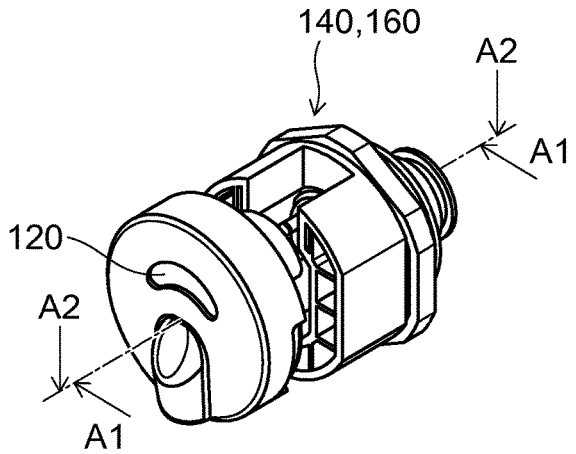
FIGS. 9A to 9C are schematic views illustrating a specific example of the water supplying device and the water sprinkling device of this embodiment.
Figure 9B:
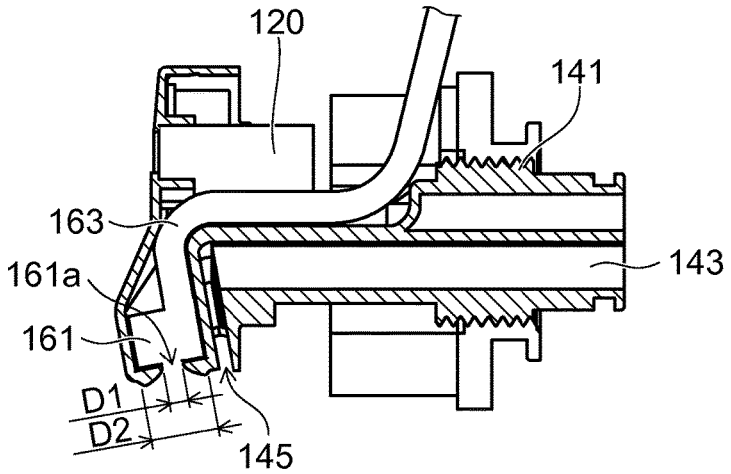
Figure 9C:
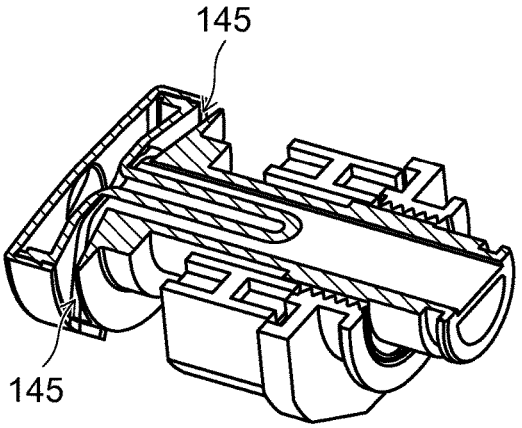

FIGS. 9A to 9C are schematic views illustrating a specific example of the water supplying device and the water sprinkling device of this embodiment.

FIG. 9A is a schematic perspective view illustrating a specific example of the water supplying device and the water sprinkling device. FIG. 9B is a schematic sectional view at cross section A1-A1 shown in FIG. 9A. FIG. 9C is a schematic sectional view at cross section A2-A2 shown in FIG. 9A.

In the specific example shown in FIGS. 9A to 9C, the water supplying device 140 and the water sprinkling device 160 are integrated with each other. As shown in FIG. 9B, the water supplying device 140 includes a spreader 141. A spreader channel 143 is provided inside the spreader 141. As shown in FIGS. 9B and 9C, a jetting port 145 is formed at one end of the spreader channel 143. The water guided through the spreader channel 143 is jetted from the jetting port 145 and supplied to the bowl section 121 of the urinal 210.

The water sprinkling device 160 includes a sprinkling section 161 and a tube 163. The sprinkling section 161 includes e.g. a nozzle, and is connected to one end of the tube 163. The sprinkling section 161 includes a sprinkling hole 161*a*. The sprinkling section 161 sprinkles water droplets from the sprinkling hole 161*a*. For instance, the sprinkling hole 161*a* has a shape such that the diameter expands from inside toward outside of the sprinkling section 161. For instance, the first diameter D1 of the sprinkling hole 161*a* is approximately 0.5 mm or more and 0.8 mm or less. For instance, the second diameter D2 of the sprinkling hole 161*a* is approximately 2.7 mm or more and 3.0 mm or less. The fresh water or sterilizing water guided through the tube 163 is sprinkled as droplets of fresh water or sterilizing water from the sprinkling section 161 and supplied to the bowl section 211 of the urinal 210.

As shown in FIGS. 9A and 9B, a human body sensing device 120 is provided inside the water supplying device 140 and the water sprinkling device 160 of this specific example. The human body sensing device 120 is as described above with reference to FIG. 1.

This embodiment is not limited to the water supplying device 140 and the water sprinkling device 160 integrated with each other.

Figure 10:
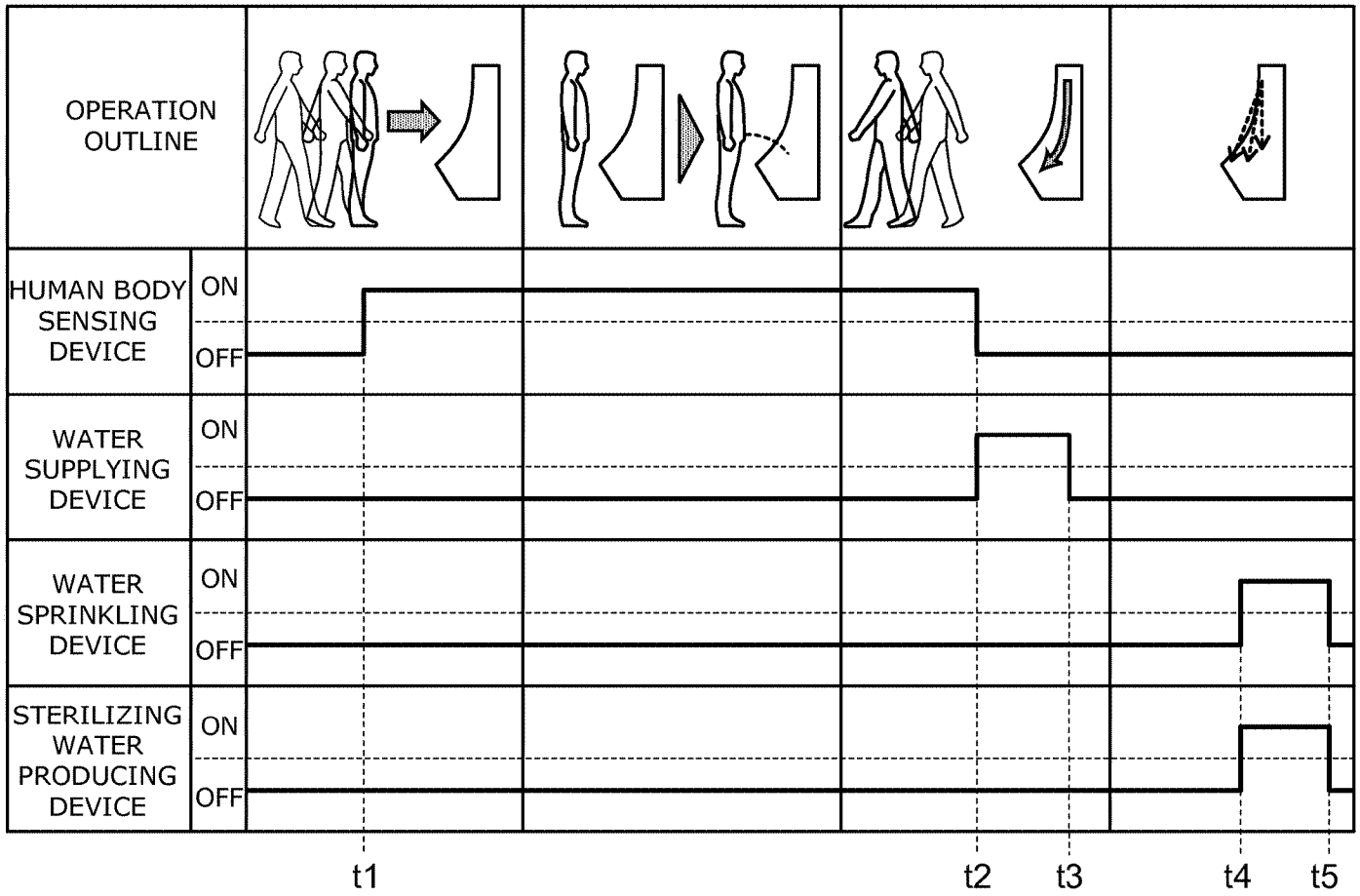
FIG. 10 is a timing chart illustrating an operation of the urinal apparatus and the urinal unit according to this embodiment.

FIG. 10 is a timing chart illustrating an operation of the urinal apparatus and the urinal unit according to this embodiment.

First, the human body sensing device 120 senses a user before the urinal 210 (timing t1).

Next, the user finishes the act of urination. The human body sensing device 120 senses the user receding from the front of the urinal 210. Then, the control section 110 controls the operation of the water supplying device 140 to supply water from the spreader 141 of the water supplying device 140 to the bowl section 211 (timing t2). A prescribed amount of water is supplied to the bowl section 211. Then, the control section 110 controls the operation of the water supplying device 140 to stop water supplied from the spreader 141 (timing t3).

The designation "ON" regarding the water supplying device 140 shown in FIG. 10 represents the operation or state in which the water supplying device 140 supplies water to the bowl section 211. The designation "OFF" regarding the water supplying device 140 shown in FIG. 10 represents the operation or state in which the water supplying device 140 does not supply water to the bowl section 211. The designations "ON" and "OFF" regarding the water supplying device 140 also apply to the timing charts shown in FIGS. 12 to 15.

Next, the human body sensing device 120 senses that the user is no longer located before the urinal 210. Then, the control section 110 controls the operation of the water sprinkling device 160 to supply fresh water from the sprinkling hole 161*a* of the water sprinkling device 160 to the bowl section 211 (timing t4).

A prescribed amount of fresh water is supplied to the bowl section 211. Then, the control section 110 controls the operation of the water sprinkling device 160 to stop fresh water sprinkled from the sprinkling hole 161*a* (timing t5).

Alternatively, the human body sensing device 120 senses that the user is no longer located before the urinal 210. Then, the control section 110 controls the operation of the sterilizing water producing device 150 and the water sprinkling device 160. Thus, sterilizing water is produced in the sterilizing water producing device 150 and supplied from the sprinkling hole 161*a* of the water sprinkling device 160 to the bowl section 211 (timing t4). The timing of the operation of the sterilizing water producing device 150 is generally equal to the timing of the operation of the water sprinkling device 160. Thus, a prescribed amount of sterilizing water is produced by the sterilizing water producing device 150 and supplied to the bowl section 211 by the water sprinkling device 160. When the sterilizing water is supplied to the bowl section 211, the control section 110 controls the operation of the sterilizing water producing device 150 and the water sprinkling device 160 to stop sterilizing water sprinkled from the sprinkling hole 161*a* (timing t5).

The designation "ON" regarding the water sprinkling device 160 shown in FIG. 10 represents the operation or state in which the water sprinkling device 160 supplies water to the bowl section 211. The designation "OFF" regarding the water sprinkling device 160 shown in FIG. 10 represents the operation or state in which the water sprinkling device 160 does not supply water to the bowl section 211. The designations "ON" and "OFF" regarding the water sprinkling device 160 also apply to the timing charts shown in FIGS. 12 to 15.

Thus, in this specific example, the human body sensing device 120 transitions from the human body sensing state to the human body non-sensing state, and the water supplying device 140 supplies water from the spreader 141 to the bowl section 211. Thereafter, the water sprinkling device 160 sprinkles fresh water or sterilizing water from the sprinkling hole 161*a* to the bowl section 211.

According to this specific example, in the case of sensing a user located at a position spaced before the urinal 210, fresh water droplets are not sprinkled from the sprinkling hole 161*a*. This can suppress discomfort to the user.

According to this specific example, the water sprinkling device 160 sprinkles sterilizing water from the sprinkling hole 161*a* to the bowl section 211 after the user terminates the act of urination. Thus, the odor of the internal space of the bowl section 211 can be deodorized. This can suppress that a subsequent user feels discomfort by the odor of the internal space of the bowl section 211.

The human body sensing device of this embodiment is further described.

Figure 11A:
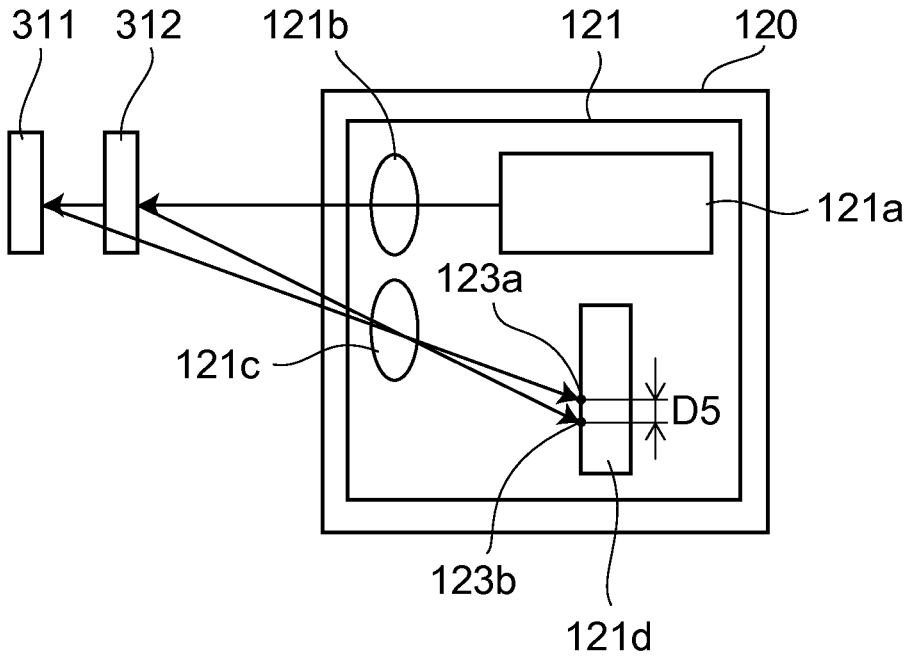
FIGS. 11A and 11B are schematic views illustrating an example of the human body sensing device of this embodiment.
Figure 11B:
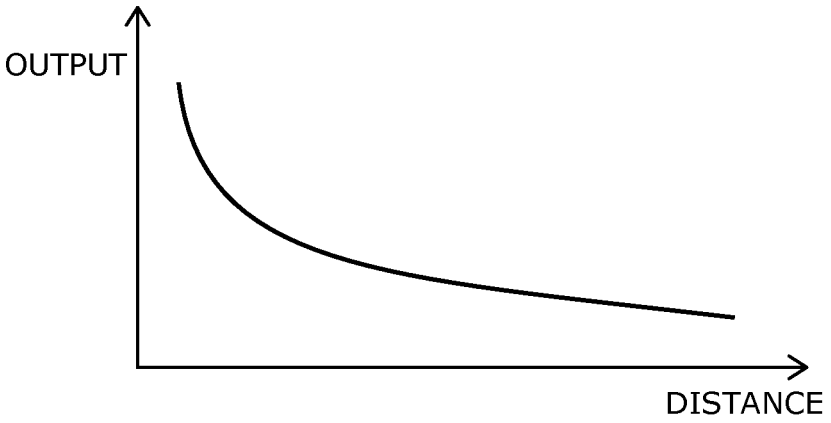

FIGS. 11A and 11B are schematic views illustrating an example of the human body sensing device of this embodiment.

FIG. 11A is a schematic plan view describing an example of the human body sensing device of this embodiment. FIG. 11B is a graph illustrating an example of the signal outputted by the human body sensing device shown in FIG. 11A.

Sensing performed by the human body sensing device 120 of this embodiment includes urinal standing sensing and urinal surrounding sensing.

The urinal standing sensing senses the presence or absence of a human body within e.g. a sensing distance of 50 centimeters (cm). For instance, the urinal standing sensing senses whether the urinal 210 has been used.

The urinal surrounding sensing senses the presence or absence of a human body within e.g. a sensing distance of 100 cm, and a human body approaching the urinal 210 or receding from the urinal 210. For instance, the urinal surrounding sensing senses the state before and after use of the urinal 210, and a human body passing around the urinal 210.

The urinal standing sensing senses the presence of a human body. In response to this sensing state, the water supplying device 140 supplies water to the bowl section 211 of the urinal 210, removes urine attached to the urinal 210, and removes foreign matter such as hair. Furthermore, the water supplying device 140 supplies water to the trap section 213 of the urinal 210 and replaces seal water inside the trap section 213 by newly supplied water. That is, the result of urinal standing sensing is one of the triggers for flushing the bowl section 211.

The urinal surrounding sensing senses the presence of a human body or approach of a human body to the urinal 210. In response to this sensing state, the water sprinkling device 160 supplies droplets of sterilizing water produced in the sterilizing water producing device 150 from the sprinkling hole 161*a* of the sprinkling section 161 to the internal space of the bowl section 211 of the urinal 210. That is, the result of urinal surrounding sensing is one of the triggers for supplying sterilizing water.

For instance, the human body sensing device 120 performs urinal standing sensing and urinal surrounding sensing by mutually different sensors.

For instance, the human body sensing device 120 includes a first infrared sensor and a second infrared sensor. In this case, for instance, the first infrared sensor senses the presence or absence of a human body within a first sensing distance to perform urinal standing sensing. For instance, the second infrared sensor senses the presence or absence of a human body within a second sensing distance different from the first sensing distance to perform urinal surrounding sensing.

Alternatively, for instance, the human body sensing device 120 includes an infrared sensor and a microwave sensor. In this case, for instance, the infrared sensor performs urinal standing sensing. For instance, the microwave sensor performs urinal surrounding sensing. The microwave sensor is more suitable for sensing a human body approaching the urinal 210 or receding from the urinal 210 than the infrared sensor.

The human body sensing device 120 is not limited to including a plurality of sensors. The human body sensing device 120 may perform urinal standing sensing and urinal surrounding sensing by one sensor.

For instance, as shown in FIG. 11A, the human body sensing device 120 includes one infrared sensor 121. The infrared sensor 121 includes an infrared light emitting diode 121*a*, a light projecting lens 121*b*, a light receiving lens 121*c*, and a light receiving element 121*d*.

The infrared light emitting diode 121*a* emits an infrared ray on a single axis. The infrared ray emitted from the infrared light emitting diode 121*a* is transmitted through the light projecting lens 121*b* and reflected at a first object 311 or a second object 312. The distance between the infrared light emitting diode 121*a* and the first object 311 is different from the distance between the infrared light emitting diode 121*a* and the second object 312. The infrared ray reflected at the first object 311 or the second object 312 is transmitted through the light receiving lens 121*c* and reaches the light receiving element 121*d*.

Here, as shown in FIG. 11A, the infrared ray reflected at the first object 311 reaches the light receiving element 121*d* at a first light receiving position 123*a*. The infrared ray reflected at the second object 312 reaches the light receiving element 121*d* at a second light receiving position 123*b*. The first light receiving position 123*a* is different from the second light receiving position 123*b*. The infrared sensor 121 calculates the distance between the infrared light emitting diode 121*a* and the first object 311 and the distance between the infrared light emitting diode 121*a* and the second object 312 based on the distance D5 between the first light receiving position 123*a* and the second light receiving position 123*b*.

As shown in FIG. 11B, the infrared sensor 121 outputs a signal corresponding to the distance between the infrared light emitting diode 121*a* and a sensed object. For instance, the infrared sensor 121 outputs a relatively high signal when the distance between the infrared light emitting diode 121*a* and the sensed object is relatively short. On the other hand, the infrared sensor 121 outputs a relatively low signal when the distance between the infrared light emitting diode 121*a* and the sensed object is relatively long. Thus, the infrared sensor 121 can perform distance sensing based on the analog value.

Figure 12A:
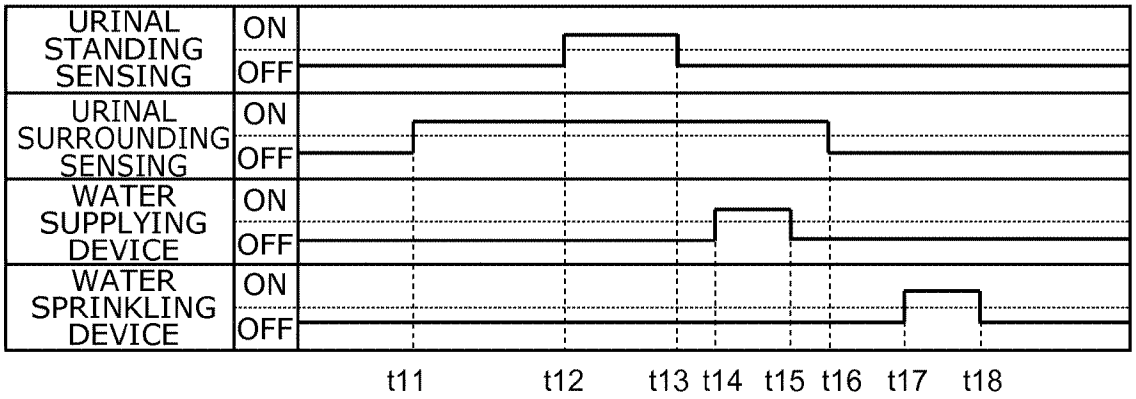
FIGS. 12A and 12B are tinning charts illustrating alternative operations of the urinal apparatus and the urinal unit according to this embodiment.
Figure 12B:
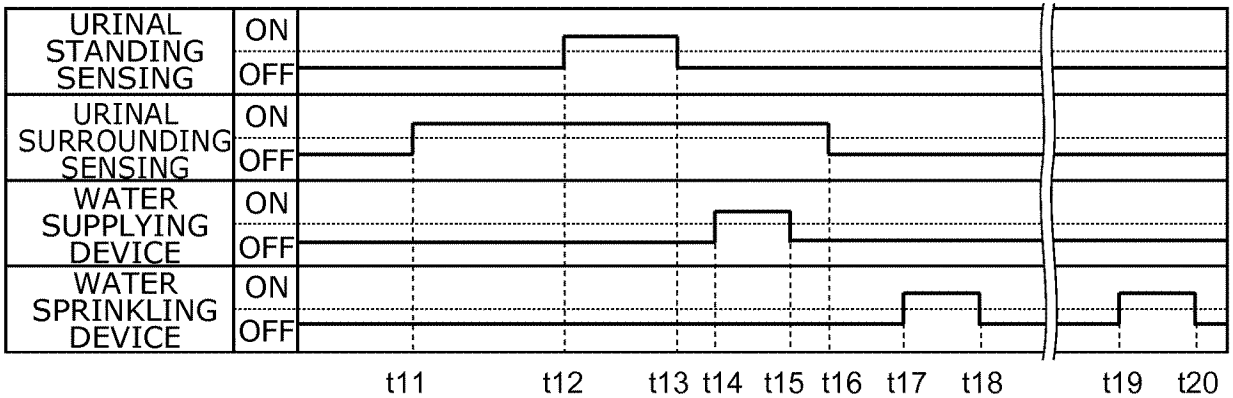

FIGS. 12A and 12B are timing charts illustrating alternative operations of the urinal apparatus and the urinal unit according to this embodiment.

FIG. 12A shows a timing chart of the normal operation of the urinal apparatus and the urinal unit. FIG. 12B shows a timing chart of the normal operation, and sprinkling flush at fixed intervals, of the urinal apparatus and the urinal unit.

As shown in FIG. 12A, first, the human body sensing device 120 senses a human body having approached the urinal 210 by urinal surrounding sensing (timing t11). Next, the human body sensing device 120 senses the presence of a human body within a prescribed sensing distance (e.g., approximately 50 cm) by urinal standing sensing (timing t12). Next, the user terminates the act of urination. The human body sensing device 120 senses the absence of a human body within a prescribed sensing distance (e.g., approximately 50 cm) (timing t13).

Then, the control section 110 controls the operation of the water supplying device 140 to supply water from the spreader 141 of the water supplying device 140 to the bowl section 211 (timing t14). A prescribed amount of water is supplied to the bowl section 211. Then, the control section 110 controls the operation of the water supplying device 140 to stop supplying water from the spreader 141 (timing t15).

Next, the human body sensing device 120 senses a human body having receded from the urinal 210 by urinal surrounding sensing (timing t16). Then, the control section 110 controls the operation of the water sprinkling device 160 to supply fresh water or sterilizing water from the sprinkling hole 161*a* of the water sprinkling device 160 to the bowl section 211 (timing t17). Alternatively, the control section 110 controls the operation of the sterilizing water producing device 150 and the water sprinkling device 160. Thus, sterilizing water is produced in the sterilizing water producing device 150 and supplied from the sprinkling hole 161*a* of the water sprinkling device 160 to the bowl section 211 (timing t17).

A prescribed amount of fresh water or sterilizing water is supplied to the bowl section 211. Then, the control section 110 controls the operation of the water sprinkling device 160 and the sterilizing water producing device 150 to stop fresh water or sterilizing water from being sprinkled from the sprinkling hole 161*a* (timing t18).

Thus, in this specific example, the human body sensing device 120 senses a human body having approached the urinal 210 and a human body having receded from the urinal 210 by urinal surrounding sensing. The control section 110 prohibits the water sprinkling device 160 from supplying fresh water or sterilizing water to the bowl section 211 after the sensing of approaching until the sensing of receding. This can suppress discomfort to the user, such as stopping approaching the urinal apparatus 100 and aborting the act intended for urination before and during the act of urination, or missing the target and splashing urine out of the bowl section 211 during urination.

As shown in FIG. 12B, even if the human body sensing device 120 does not sense the use of the urinal 210, the water sprinkling device 160 may perform sprinkling flush at fixed intervals. For instance, sterilizing water sprinkled from the sprinkling hole 161*a* is stopped (timing t18). Then, the control section 110 controls the operation of the sterilizing water producing device 150 and the water sprinkling device 160. Thus, sterilizing water is produced in the sterilizing water producing device 150 and supplied from the sprinkling hole 161*a* of the water sprinkling device 160 to the bowl section 211 (timing t19). A prescribed amount of sterilizing water is supplied to the bowl section 211. Then, the control section 110 controls the operation of the sterilizing water producing device 150 and the water sprinkling device 160 to stop sterilizing water sprinkled from the sprinkling hole 161*a* (timing t20).

Sprinkling flush performed at fixed intervals renews the water in the flow channel at fixed intervals. Thus, the sterilizing water produced in the sterilizing water producing device 150 does not continue to stay e.g. inside the sterilizing water producing device 150 and in the flow channel located on the downstream side of the sterilizing water producing device 150. Furthermore, activation of bacteria is suppressed, and bacteria can be minimized. This can suppress clogging of the sprinkling hole 161*a* of the water sprinkling device 160 due to production of biofilm. Furthermore, this can suppress sprinkling of water in an unintended direction from the water sprinkling device 160.

When the water sprinkling device 160 performs sprinkling flush (timing t19), bowl flush may be performed simultaneously. For instance, the control section 110 controls the operation of the water supplying device 140 to supply water from the spreader 141 of the water supplying device 140 to the bowl section 211. A prescribed amount of water is supplied to the bowl section 211. Then, the control section 110 controls the operation of the water supplying device 140 to stop water supplied from the spreader 141. This can suppress that e.g. the flow channel near the flow channel switching valve 130 located on the upstream side of the sterilizing water producing device 150 is clogged by production of biofilm.

Figure 13:
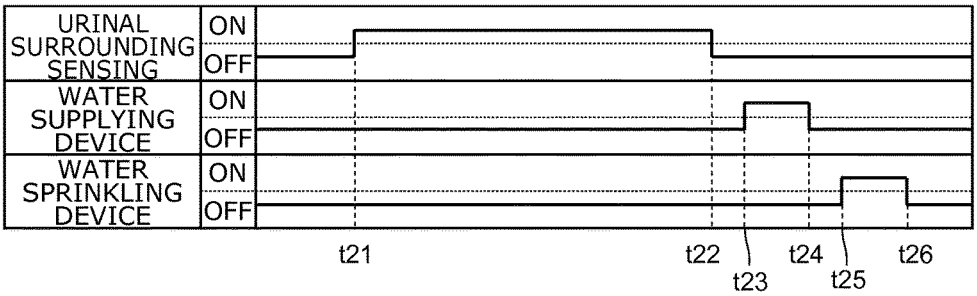
FIG. 13 is a timing chart illustrating a further alternative operation of the urinal apparatus and the urinal unit according to this embodiment.

FIG. 13 is a timing chart illustrating a further alternative operation of the urinal apparatus and the urinal unit according to this embodiment.

As described above with reference to FIGS. 11A and 11B, the human body sensing device 120 may perform urinal standing sensing and urinal surrounding sensing by one sensor. FIG. 13 is a timing chart showing the case where the human body sensing device 120 performs both urinal standing sensing and urinal surrounding sensing by one sensor.

First, the human body sensing device 120 senses a human body having approached the urinal 210 by urinal surrounding sensing (timing t21). Next, the human body sensing device 120 senses a human body having receded from the urinal 210 by urinal surrounding sensing (timing t22). Then, the control section 110 controls the operation of the water supplying device 140 to supply water from the spreader 141 of the water supplying device 140 to the bowl section 211 (timing t23). A prescribed amount of water is supplied to the bowl section 211. Then, the control section 110 controls the operation of the water supplying device 140 to stop water supplied from the spreader 141 (timing t24).

Next, the control section 110 controls the operation of the water sprinkling device 160 to supply fresh water from the sprinkling hole 161*a* of the water sprinkling device 160 to the bowl section 211 (timing t25). Alternatively, the control section 110 controls the operation of the sterilizing water producing device 150 and the water sprinkling device 160. Thus, sterilizing water is produced in the sterilizing water producing device 150 and supplied from the sprinkling hole 161*a* of the water sprinkling device 160 to the bowl section 211 (timing t25).

A prescribed amount of fresh water or sterilizing water is supplied to the bowl section 211. Then, the control section 110 controls the operation of the water sprinkling device 160 and the sterilizing water producing device 150 to stop fresh water or sterilizing water sprinkled from the sprinkling hole 161*a* (timing t26).

Thus, in this specific example, the human body sensing device 120 performs both urinal standing sensing and urinal surrounding sensing by one sensor. Even in this case, the human body sensing device 120 senses a human body having approached the urinal 210 and a human body having receded from the urinal 210 by urinal surrounding sensing. The control section 110 prohibits the water sprinkling device 160 from supplying fresh water or sterilizing water to the bowl section 211 after the sensing of approaching until the sensing of receding. This can achieve an effect similar to that described above with reference to FIGS. 12A and 12B.

Figure 14:
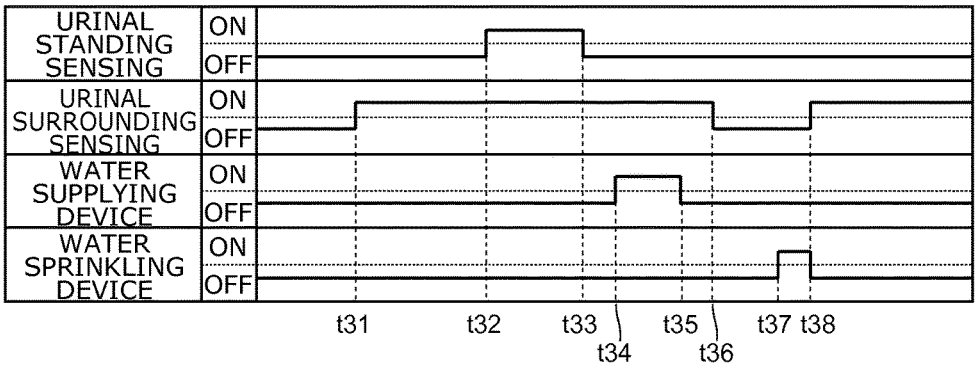
FIG. 14 is a timing chart illustrating a further alternative operation of the urinal apparatus and the urinal unit according to this embodiment.

FIG. 14 is a timing chart illustrating a further alternative operation of the urinal apparatus and the urinal unit according to this embodiment.

FIG. 14 is a timing chart showing the case where a human body approaches the urinal 210 when the water sprinkling device 160 is supplying fresh water or sterilizing water to the bowl section 211.

The operation at timings t31-t37 is similar to the operation at timings t11-t17 described above with reference to FIGS. 12A and 12B.

Next, the human body sensing device 120 senses a human body having approached the urinal 210 by urinal surrounding sensing when the water sprinkling device 160 is supplying fresh water or sterilizing water to the bowl section 211. Then, the control section 110 controls the operation of the water sprinkling device 160 to stop fresh water or sterilizing water sprinkled from the sprinkling hole 161*a* (timing t38).

According to this specific example, the human body sensing device 120 senses a human body having approached the urinal 210 by urinal surrounding sensing. Then, even when the water sprinkling device 160 is supplying fresh water or sterilizing water to the bowl section 211, the control section 110 stops supplying the fresh water or sterilizing water. This can achieve an effect similar to that described above with reference to FIGS. 12A and 12B.

Figure 15:
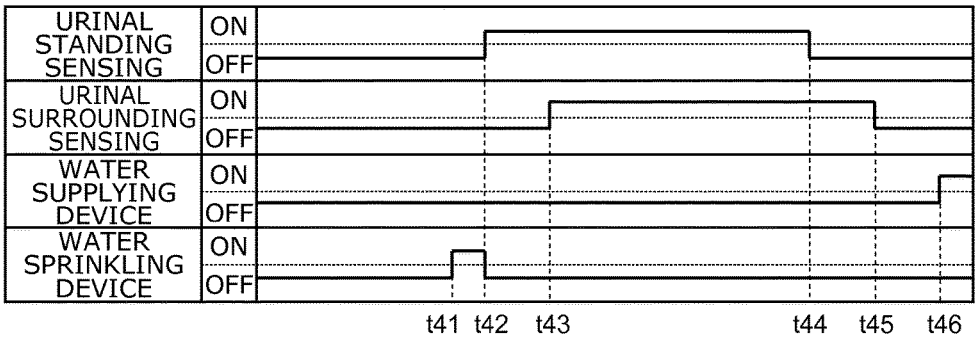
FIG. 15 is a timing chart illustrating a further alternative operation of the urinal apparatus and the urinal unit according to this embodiment.

FIG. 15 is a timing chart illustrating a further alternative operation of the urinal apparatus and the urinal unit according to this embodiment.

FIG. 15 is a timing chart showing the case where a human body has suddenly entered the sensing range of the human body sensing device 120 from outside. The case where a human body has suddenly entered the sensing range of the human body sensing device 120 from outside includes e.g. the case where a human body has moved from just beside the urinal 210 to the front of the urinal 210.

In this specific example, it is assumed that the water sprinkling device 160 is supplying fresh water or sterilizing water to the bowl section 211 (timing t41). At this time, the human body sensing device 120 senses the presence of a human body within a prescribed sensing distance (e.g., approximately 50 cm) by urinal standing sensing. Then, the control section 110 controls the operation of the water sprinkling device 160 to stop fresh water or sterilizing water sprinkled from the sprinkling hole 161*a* (timing t42).

Next, the human body sensing device 120 senses a human body having approached the urinal 210 by urinal surrounding sensing (timing t43). Next, the user terminates the act of urination. The human body sensing device 120 senses the absence of a human body within a prescribed sensing distance (e.g., approximately 50 cm) (timing t44). Next, the human body sensing device 120 senses a human body having receded from the urinal 210 by urinal surrounding sensing (timing t45).

Then, the control section 110 controls the operation of the water supplying device 140 to supply water from the spreader 141 of the water supplying device 140 to the bowl section 211 (timing t46).

Thus, in this specific example, the human body sensing device 120 senses the presence of a human body within a prescribed sensing distance (e.g., approximately 50 cm) by urinal standing sensing before sensing a human body having approached the urinal 210 by urinal surrounding sensing. Then, even when the water sprinkling device 160 is supplying fresh water or sterilizing water to the bowl section 211, the control section 110 stops supplying the fresh water or sterilizing water. This can achieve an effect similar to that described above with reference to FIGS. 12A and 12B.

Figure 16:
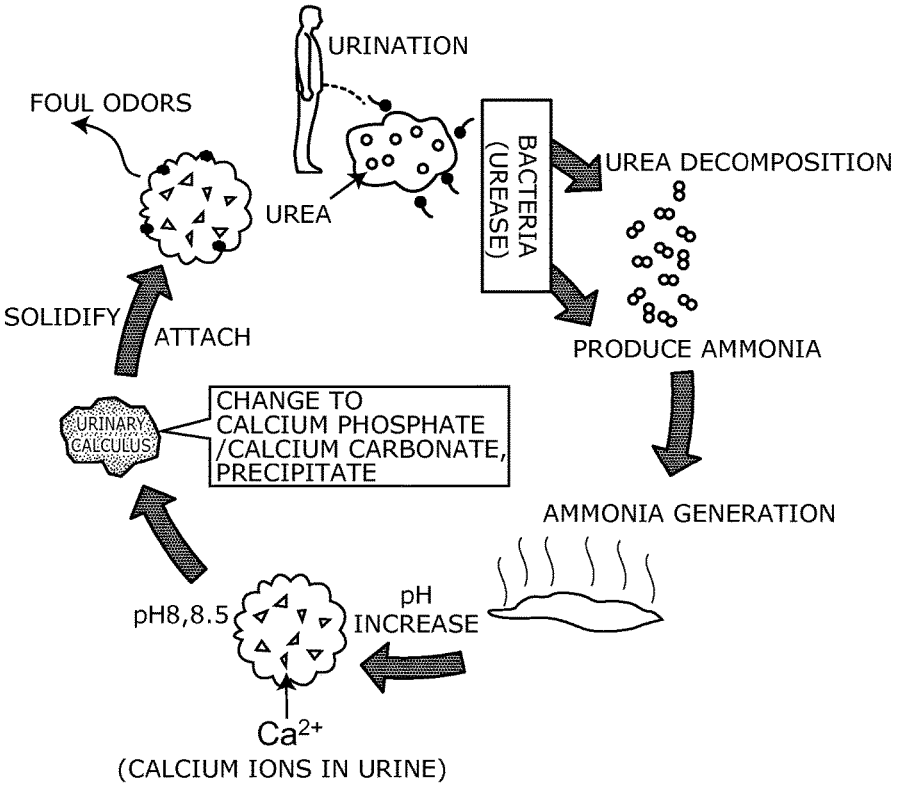
FIG. 16 is a schematic view illustrating a mechanism of the generation of ammonia.

FIG. 16 describes a mechanism of the generation of ammonia.

The mechanism of the generation of ammonia is e.g. as follows.

After urination into the toilet bowl, urine is attached to the surface of the toilet bowl, or retained in the seal water (retention water) of the trap section. Common bacteria existing e.g. in the air or on the toilet bowl surface are attached to the retained urine. The common bacteria absorb nutrition from urine. This activates the activity of producing urease enzyme. The urease enzyme promotes the decomposition of urea. Urea is decomposed into ammonia and carbon dioxide. This ammonia causes foul odors. Furthermore, the generated ammonia shifts the hydrogen ion concentration (pH) of the decomposition product to alkalinity. If pH is shifted to alkalinity beyond 8.0 to 8.5, calcium ions dissolved in urine are turned into poorly soluble calcium compounds (such as calcium phosphate, also commonly referred to as urinary calculus). This urinary calculus incubates bacteria and repeats the foregoing process in an accelerated manner. Thus, ammonia is further generated.

Activation of bacteria in urine attached to the surface of the toilet bowl or urine retained in the seal water of the trap section takes a prescribed time. The "prescribed time" is e.g. approximately two hours or more. Thus, increase of pH and generation of odor and urinary calculus (soil) can be suppressed if less than two hours has elapsed after urine is attached to the surface of the toilet bowl or retained in the seal water of the trap section.

In view of the mechanism of the generation of ammonia, it is desirable that the water sprinkling device 160 sprinkle fresh water from the sprinkling hole 161*a* at a fixed cycle. Activation of bacteria in urine remaining in the trap section 213 of the urinal 210 takes a prescribed time. Activation of bacteria soils the trap section 213 of the urinal 210, causes accumulation of urinary calculus, and generates odor from the trap section 213. However, operation of the water sprinkling device 160 at a fixed cycle can maintain the state in which urine from the trap section 213 is diluted with fresh water below a certain concentration. This can suppress odor from the trap section 213.

Next, the case where it is determined that the sterilizing water producing device of this embodiment is faulty is described with reference to the drawings.

As described above with reference to FIG. 2, the sterilizing water producing device 150 can produce sterilizing water from the water supplied from the feedwater source based on the signal transmitted from the control section 110. However, the sterilizing water producing device 150 cannot produce sterilizing water when it is faulty. When the sterilizing water producing device 150 is faulty, the water (fresh water) supplied from the feedwater source is guided to the water sprinkling device 160 without changing to sterilizing water in the sterilizing water producing device 150. Then, miscellaneous water is sprinkled from the water sprinkling device 160. Thus, the sprinkling hole 161*a* of the water sprinkling device 160 may be clogged by the production of biofilm.

In contrast, in the urinal apparatus 100 according to this embodiment, when the control section 110 determines that the sterilizing water producing device 150 is faulty, the control section 110 performs control for prohibiting the sprinkling of the water sprinkling device 160.

Thus, bacteria and microorganisms contained in the miscellaneous water can be sterilized to suppress the production of biofilm on the upstream of the water sprinkling device. This can suppress clogging of the sprinkling hole 161*a* of the water sprinkling device 160 due to production of biofilm. Furthermore, this can suppress sprinkling of water in an unintended direction from the water sprinkling device 160.

For instance, in the sterilizing water producing device 150 described with reference to FIG. 7, conductive foreign matter may be interposed between the anode plate 153 and the cathode plate 155. Then, the anode plate 153 and the cathode plate 155 are made electrically continuous with each other. This causes a short circuit between the anode plate 153 and the cathode plate 155. When a short circuit occurs, the voltage applied between the anode plate 153 and the cathode plate 155 cannot maintain a prescribed voltage (e.g., 24 V), but decreases from the prescribed voltage. Thus, the control section 110 can determine that the sterilizing water producing device 150 is faulty when the voltage applied between the anode plate 153 and the cathode plate 155 is less than or equal to a prescribed value (e.g., 23 V).

According to this specific example, the fault of the sterilizing water producing device 150 can be sensed more easily. The values in this specific example are illustrative only. The voltage value (prescribed value) at which the control section 110 determines that the sterilizing water producing device 150 is faulty is not limited to 23 V.

Figure 17:
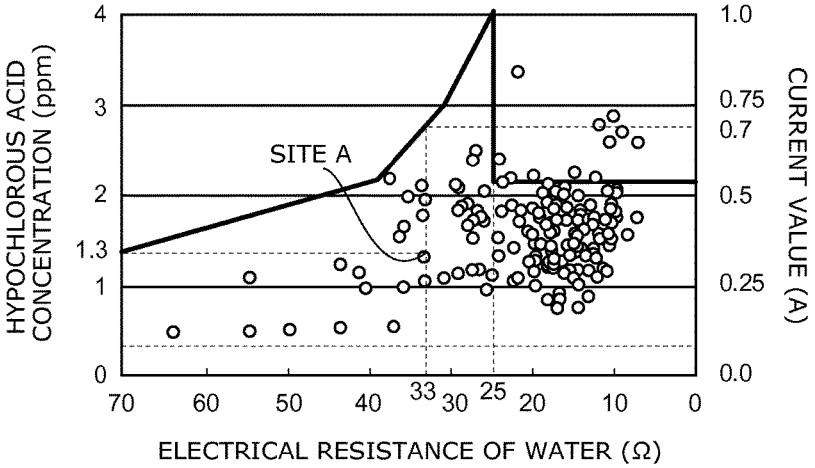
FIG. 17 is a graph illustrating an example of the relationship between the electrical resistance of water and the hypochlorous acid concentration and the relationship between the electrical resistance of water and the current value.

FIG. 17 is a graph illustrating an example of the relationship between the electrical resistance of water and the hypochlorous acid concentration and the relationship between the electrical resistance of water and the current value.

FIGS. 18A to 18E are schematic sectional views describing the degradation process of the electrode of the sterilizing water producing device.

Figure 19:
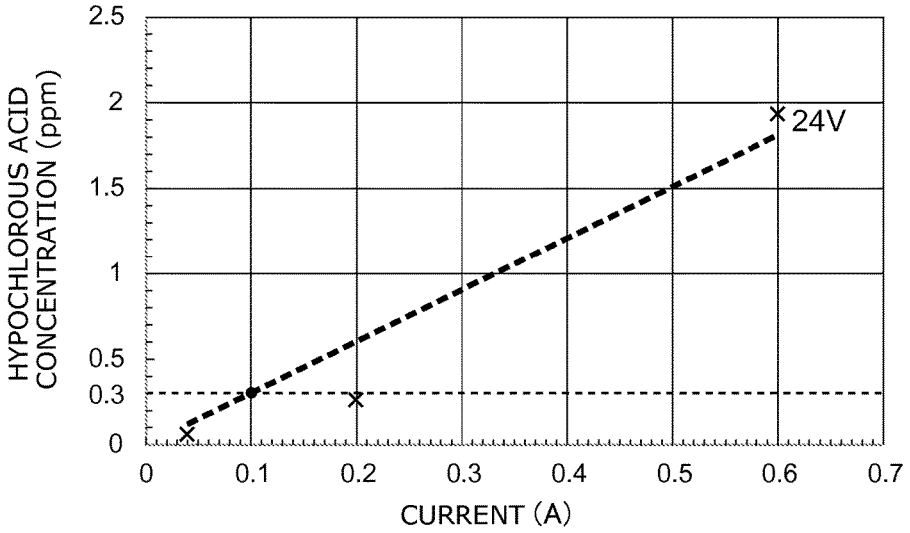
FIG. 19 is a graph illustrating an example of the relationship between the current value and the hypochlorous acid concentration.

FIG. 19 is a graph illustrating an example of the relationship between the current value and the hypochlorous acid concentration.

The electrical resistance of water shown in FIG. 17 represents the electrical resistance value of fresh water (e.g., water before passing through the sterilizing water producing device 150). The hypochlorous acid concentration shown in FIG. 17 represents the concentration of chlorine contained in the water electrolyzed in the sterilizing water producing device 150, rather than the concentration of chlorine contained in tap water. The current value shown in FIG. 17 represents the value of the current flowing in the sterilizing water producing device 150.

The points shown in FIG. 17 represent the relationship between the electrical resistance of water and the hypochlorous acid concentration. The line shown in FIG. 17 represents the relationship between the electrical resistance of water and the current value.

The concentration of chlorine contained in water changes with places (regions). The electrical resistance of water changes with the concentration of chlorine contained in the water. Thus, the electrical conductivity of water changes with places. Accordingly, the current flowing in the water applied with a fixed voltage changes with places.

For instance, the electrical resistance of water of site A shown in FIG. 17 is 33 ohms (Ω). When a voltage of e.g. 24 volts (V) is applied to the sterilizing water producing device 150, a current of 0.7 amperes (A) flows in the sterilizing water producing device 150. In this case, the concentration of chlorine contained in the water electrolyzed in the sterilizing water producing device 150 is 1.3 ppm (parts per million). In the graph shown in FIG. 17, when the electrical resistance of water is less than 25Ω, the voltage applied to the sterilizing water producing device 150 is made lower than 24 V. Thus, the current flowing in the sterilizing water producing device 150 is maintained at 0.55 A. The numerical values shown in FIG. 17 are illustrative only, and not limited thereto.

Thus, the electrical conductivity of water is determined almost by the supply source (water source) of tap water. Accordingly, the value of the current flowing in water applied with a fixed voltage is nearly constant unless the installation position of the urinal apparatus 100 is changed.

Here, as shown in FIGS. 18A to 18E, the electrode (anode plate 153 and cathode plate 155) of the sterilizing water producing device 150 is degraded with the passage of electrolysis time (energization time). This is now further described. The degradation process of the cathode plate 155 is the same as the degradation process of the anode plate 153. The degradation process of the anode plate 153 is taken as an example in the description of this specific example.

The anode plate 153 includes a metal plate 153*a*, an intermediate layer 153*b*, and a catalyst layer 153*c*. The metal plate 153*a* includes a metal such as titanium (Ti). As shown in FIGS. 18D and 18E, the intermediate layer 153*b* has cracks 153*e*. The catalyst layer 153*c* includes a catalyst 153*d*. The catalyst layer 153*c* has a structure in which the catalyst 153*d* is formed in a plurality of layers.

The catalyst layer 153*c* is spaced from the metal plate 153*a*. The intermediate layer 153*b* is provided between the metal plate 153*a* and the catalyst layer 153*c*. Part of the catalyst 153*d* is inserted into the crack 153*e* of the intermediate layer 153*b*.

Figure 18A:
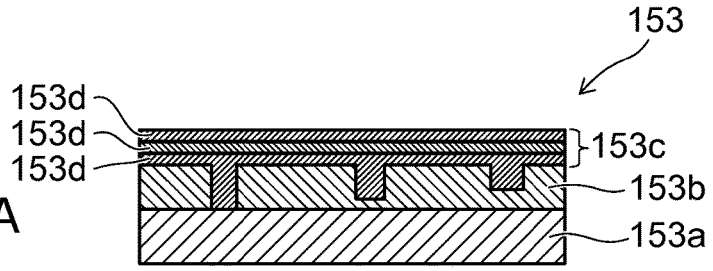
FIGS. 18A to 18E are schematic sectional views describing the degradation process of the electrode of the sterilizing water producing device.

FIG. 18A shows the state of the anode plate 153 at an electrolysis time of zero hours (hr).

Figure 18B:
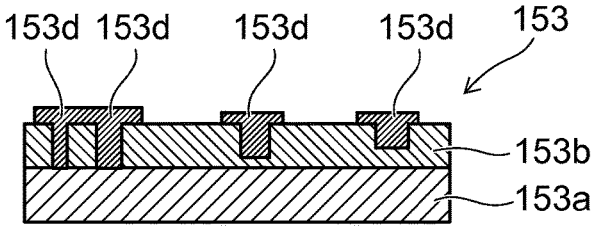

As shown in FIG. 18B, with the passage of electrolysis time, part of the catalyst 153*d* of the catalyst layer 153*c* is detached. FIG. 18B shows the state of the anode plate 153 at an electrolysis time of e.g. approximately 20 hr or more and 30 hr or less.

Figure 18C:
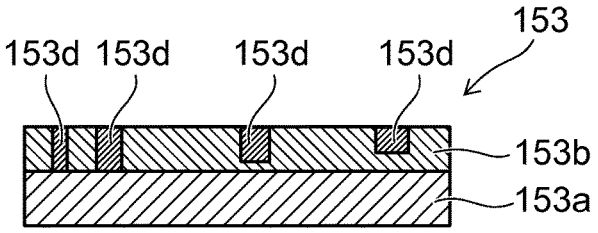
Figure 18D:
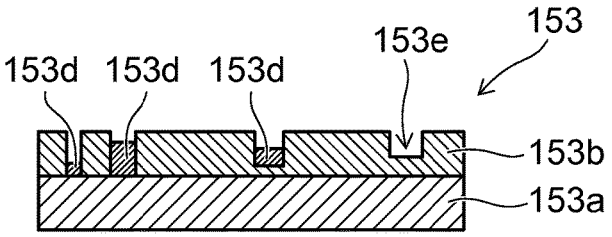
Figure 18E:
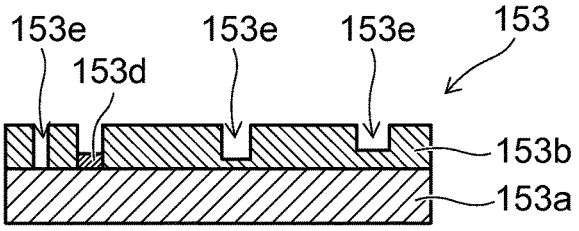

As shown in FIG. 18C, with further passage of electrolysis time, the catalyst layer 153*c* provided on the intermediate layer 153*b* is detached. FIG. 18C shows the state of the anode plate 153 at an electrolysis time of e.g. approximately 100 hr or more and 200 hr or less.

As shown in FIG. 18D, with further passage of electrolysis time, part of the catalyst 153*d* inserted into the crack 153*e* of the intermediate layer 153*b* is detached. FIG. 18D shows the state of the anode plate 153 at an electrolysis time of e.g. approximately 300 hr or more and 350 hr or less.

As shown in FIG. 18E, with further passage of electrolysis time, the catalyst 153*d* inserted into the crack 153*e* of the intermediate layer 153*b* is detached. Thus, the metal plate 153*a* is exposed. FIG. 18E shows the state of the anode plate 153 at an electrolysis time of e.g. approximately 360 hr or more and 400 hr or less.

The electrode of the sterilizing water producing device 150 is degraded with the passage of electrolysis time through the degradation process shown in e.g. FIGS. 18A to 18E. The resistance of the electrode is increased by the degradation of the electrode of the sterilizing water producing device 150. Furthermore, the production concentration of sterilizing water is decreased by the degradation of the electrode of the sterilizing water producing device 150 with the passage of electrolysis time (see FIG. 20).

As described above with reference to FIG. 7, when the sterilizing water producing device 150 produces sterilizing water, a prescribed voltage (e.g., approximately 24 volts (V)) is applied to the electrode of the sterilizing water producing device 150. The electrode of the sterilizing water producing device 150 is degraded. This increases the resistance of the electrode and decreases the value of the current flowing in the water. Thus, the control section 110 can determine that the sterilizing water producing device 150 is faulty when the current flowing between the anode plate 153 and the cathode plate 155 is less than or equal to a prescribed value.

The inventor collected water in a region. The inventor investigated the relationship between the value of the current flowing in the water and the concentration of hypochlorous acid produced in the sterilizing water producing device 150. The result of the investigation is as shown in FIG. 19. More specifically, in the water of this region, a current of 0.6 amperes (A) passed in the water produces a liquid containing hypochlorous acid at a concentration of approximately 1.9 ppm (sterilizing water).

The electrode of the sterilizing water producing device 150 is degraded through the degradation process shown in e.g. FIGS. 18A to 18E. This decreases the value of the current flowing in the water. As shown in FIG. 19, the concentration of hypochlorous acid produced in the sterilizing water producing device 150 decreases with the decrease of the value of the current flowing in the water. For the water of this region, the concentration of hypochlorous acid is set to 0.3 ppm. In this case, the control section 110 can determine that the sterilizing water producing device 150 is faulty when the current flowing between the anode plate 153 and the cathode plate 155 is 0.1 A or less.

According to this specific example, the fault of the sterilizing water producing device 150 can be sensed more easily. The values in this specific example are illustrative only. The current value (prescribed value) at which the control section 110 determines that the sterilizing water producing device 150 is faulty is not limited to 0.1 A.

Figure 20:
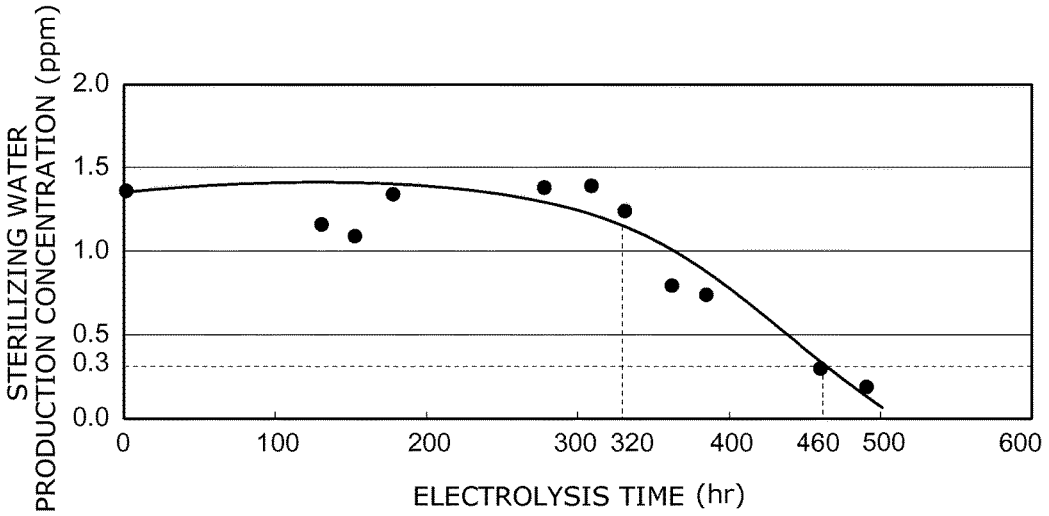
FIG. 20 is a graph illustrating an example of the relationship between the electrolysis time of the sterilizing water producing device and the sterilizing water production concentration.

FIG. 20 is a graph illustrating an example of the relationship between the electrolysis time of the sterilizing water producing device and the sterilizing water production concentration.

In this investigation, a current of 1 A was passed in the electrode of the sterilizing water producing device 150. Furthermore, pole change was performed at intervals of five seconds. In pole change, the anode plate 153 and the cathode plate 155 are switched to each other. Under this condition, the inventor investigated the relationship between the passage of electrolysis time (energization time of the electrode) of the sterilizing water producing device 150 and the production concentration of sterilizing water. The result of the investigation is as shown in FIG. 20.

More specifically, the production concentration of sterilizing water decreases with the passage of electrolysis time of the sterilizing water producing device 150. As shown in FIG. 17, the electrical resistance of water is high for a low hypochlorous acid concentration. Thus, the current flowing in the water applied with a fixed voltage is low for a low hypochlorous acid concentration. Thus, assuming the case where a current of 1 A flows, the inventor found that a concentration of sterilizing water of 0.3 ppm or more is needed to achieve the effect of the sterilizing water more reliably.

According to the graph shown in FIG. 20, a concentration of sterilizing water of 0.3 ppm or more can be achieved when the electrolysis time is less than 460 hr. Thus, the control section 110 can determine that the sterilizing water producing device 150 is faulty when the electrolysis time of the sterilizing water producing device 150 is more than or equal to a prescribed value. More specifically, the control section 110 can determine that the sterilizing water producing device 150 is faulty when the electrolysis time of the sterilizing water producing device 150 is 460 hr or more. Alternatively, in view of safety factor (e.g., approximately 1.5), the control section 110 may determine that the sterilizing water producing device 150 is faulty when the electrolysis time of the sterilizing water producing device 150 is 320 hr or more.

According to this specific example, the fault of the sterilizing water producing device 150 can be sensed more easily. The values in this specific example are illustrative only. The electrolysis time (prescribed value) at which the control section 110 determines that the sterilizing water producing device 150 is faulty is not limited to 460 hr or 320 hr.

This specific example sets an electrolysis time (second prescribed value) shorter than the electrolysis time (first prescribed value) at which the control section 110 determines that the sterilizing water producing device 150 is faulty. The control section 110 performs control for increasing the voltage applied between the anode plate 153 and the cathode plate 155 when the electrolysis time of the sterilizing water producing device 150 is less than the first prescribed value and more than or equal to the second prescribed value. Then, the voltage applied between the anode plate 153 and the cathode plate 155 increases while the production concentration of sterilizing water is decreased by the degradation of the electrode of the sterilizing water producing device 150. This can maintain the production concentration of sterilizing water at a generally fixed level.

Figure 21:
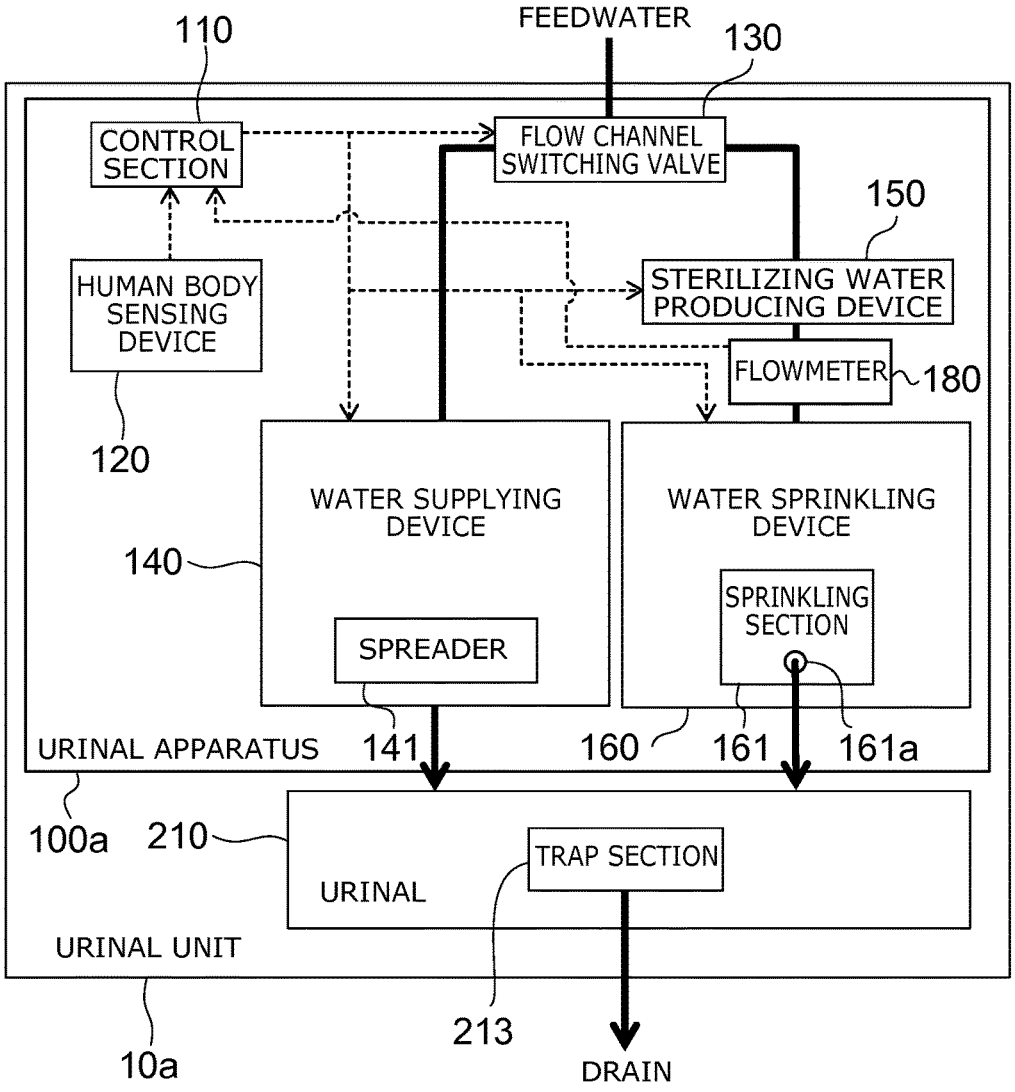
FIG. 21 is a block diagram describing an alternative specific example of determining the fault of the sterilizing water producing device.

FIG. 21 is a block diagram describing an alternative specific example of determining the fault of the sterilizing water producing device.

The urinal unit 10*a* shown in FIG. 21 includes a urinal apparatus 100*a* and a urinal 210. The urinal apparatus 100*a* is different from the urinal apparatus 100 described above with reference to FIG. 2 in further including a flowmeter 180.

The flowmeter 180 is provided between the sterilizing water producing device 150 and the water sprinkling device 160. Alternatively, the flowmeter 180 may be provided between the flow channel switching valve 130 and the sterilizing water producing device 150. Alternatively, the flowmeter 180 may be provided on the upstream side of the flow channel switching valve 130. The flowmeter 180 detects the flow rate of water flowing in the flow channel on which the flowmeter 180 itself is placed. The measurement error of the flowmeter 180 is e.g. approximately ±50 milliliters/min (mL/min). The rest of the structure is similar to the structure of the urinal apparatus 100 described above with reference to FIG. 2.

The flow rate of water flowing in the sterilizing water producing device 150 decreases when the sprinkling hole 161*a* is clogged by production of biofilm. Thus, the control section 110 can determine that the sterilizing water producing device 150 is faulty when the flow rate detected by the flowmeter 180 (flow rate of water flowing in the sterilizing water producing device 150) is less than or equal to a prescribed value. Alternatively, the control section 110 can determine that the sterilizing water producing device 150 is faulty when the amount of water (integrated amount of water) flowing in the sterilizing water producing device 150 is more than or equal to a prescribed value.

For instance, the case where the flow rate of water flowing in the sterilizing water producing device 150 is set to 250 mL/min or more and 450 mL/min or less is taken as an example in the following description. As described above, the measurement error of the flowmeter 180 is e.g. approximately ±50 mL/min. Thus, the control section 110 can determine that the sterilizing water producing device 150 is faulty when the flow rate of water flowing in the sterilizing water producing device 150 is 200 mL/min or less.

Alternatively, as described above with reference to FIG. 20, the control section 110 determines that the sterilizing water producing device 150 is faulty after the passage of an electrolysis time of e.g. 320 hr. Consider the case where the flow rate of water flowing in the sterilizing water producing device 150 is a maximum of 450 mL/min. In this case, the amount of water (integrated amount of water) flowing by the passage of an electrolysis time of 320 hr is given by the following equation.

$$450\ (\text{mL/min}) \times 320\ (\text{hr}) \times 60/1000 = 8640\ (\text{L})$$

Thus, the control section 110 can determine that the sterilizing water producing device 150 is faulty when the amount of water (integrated amount of water) flowing in the sterilizing water producing device 150 is 8640 L or more.

According to this specific example, the fault of the sterilizing water producing device 150 can be sensed more easily.

The values in this specific example are illustrative only. The flow rate (prescribed value) at which the control section 110 determines that the sterilizing water producing device 150 is faulty is not limited to 200 mL/min. The integrated amount of water (prescribed value) at which the control section 110 determines that the sterilizing water producing device 150 is faulty is not limited to 8640 L.

This specific example sets an integrated amount of water (second prescribed value) smaller than the integrated amount of water (first prescribed value) at which the control section 110 determines that the sterilizing water producing device 150 is faulty. The control section 110 performs control for increasing the voltage applied between the anode plate 153 and the cathode plate 155 when the integrated amount of water flowing in the sterilizing water producing device 150 is less than the first prescribed value and more than or equal to the second prescribed value. Then, the voltage applied between the anode plate 153 and the cathode plate 155 increases while the production concentration of sterilizing water is decreased by the degradation of the electrode of the sterilizing water producing device 150. This can maintain the production concentration of sterilizing water at a generally fixed level.

The embodiments of the invention have been described above. However, the invention is not limited to the above description. Those skilled in the art can appropriately modify the design of the above embodiments. Such modifications are also encompassed within the scope of the invention as long as they include the features of the invention. For instance, the shape, dimension, material, and placement of each element of the water supplying device 140 and the water sprinkling device 160, and the installation mode of the water supplying device 140, the water sprinkling device 160, and the human body sensing device 120 are not limited to those illustrated above, but can be appropriately modified.

Furthermore, the elements of the above embodiments can be combined with each other as long as technically feasible. Such combinations are also encompassed within the scope of the invention as long as they include the features of the invention.

What is claimed is:

1. A urinal apparatus comprising:

a water supplying device configured to supply water to a bowl surface of a bowl section of a urinal, and to remove urine attached to the bowl surface of the urinal;

a water sprinkling device including a sprinkling hole configured to sprinkle water to a space inside the bowl section; and a human body sensing device configured to sense use of the urinal, the human body sensing device performing urinal standing sensing and urinal surrounding sensing, the human body sensing device sensing presence or absence of a human body within a first sensing distance by the urinal standing sensing, the human body sensing device sensing presence or absence of a human body within a second sensing distance by the urinal surrounding sensing, the second sensing distance being longer than the first sensing distance, the water supplying device supplying the water when the human body sensing device has transitioned from a human body sensing state to a human body non-sensing state by the urinal standing sensing, the water sprinkling device being prohibited from sprinkling the water from the sprinkling hole while the human body sensing device, performing the urinal surrounding sensing, is in a human body sensing state, and an amount of water supplied to the bowl section in one operation by the water supplying device is larger than an amount of water sprinkled to the space in one operation by the water sprinkling device.

2. The apparatus according to claim 1, wherein the water sprinkling device is able to sprinkle the water to the space after the human body sensing device transitions from the human body sensing state to the human body non-sensing state and the water supplying device supplies the water to the bowl section.

3. The apparatus according to claim 1, wherein the water sprinkling device sprinkles the water from the sprinkling hole at a fixed cycle.

4. The apparatus according to claim 1, wherein the water supplying device includes a hole configured to sprinkle water to the bowl section.

5. The apparatus according to claim 4, wherein the apparatus performs a facility protecting flush operation for supplying water to the bowl section at a fixed cycle, and an amount of the water supplied to the bowl section in one operation of the facility protecting flush operation is larger than an amount of water sprinkled to the bowl section in one operation by the water supplying device or an amount of water sprinkled to the space in one operation by the water sprinkling device.

6. The apparatus according to claim 1, further comprising:

a sterilizing water producing device provided on an upstream side of the water sprinkling device and configured to produce sterilizing water, wherein the water sprinkling device sprinkles droplets of the sterilizing water produced by the sterilizing water producing device to the space inside the bowl section.

7. The apparatus according to claim 6, wherein the sterilizing water producing device is actuated when the water sprinkling device is actuated, and deactuated when the water sprinkling device is deactuated.

8. The apparatus according to claim 7, wherein an amount of water supplied to the bowl section in one operation by the water supplying device is larger than an amount of water sprinkled to the space in one operation by the water sprinkling device, and the water supplied by the water supplying device is fresh water excluding the sterilizing water.

9. The apparatus according to claim 7, further comprising:

a flow channel communicating the sterilizing water producing device with the water sprinkling device, wherein sterilizing water in the flow channel is drained a prescribed time after the water sprinkling device is deactuated.

10. The apparatus according to claim 7, further comprising:

a flow channel communicating the sterilizing water producing device with the water sprinkling device, wherein sterilizing water in the flow channel is drained from a drain hole different from the sprinkling hole after the water sprinkling device is actuated.

11. The apparatus according to claim 6, wherein the sterilizing water remaining after being produced by the sterilizing water producing device is drained at fixed intervals.

12. The apparatus according to claim 11, wherein an amount of water supplied to the bowl section in one operation by the water supplying device is larger than an amount of water sprinkled to the space in one operation by the water sprinkling device, and the water supplied by the water supplying device is fresh water excluding the sterilizing water.

13. The apparatus according to claim 11, further comprising:

a flow channel communicating the sterilizing water producing device with the water sprinkling device, wherein sterilizing water in the flow channel is drained a prescribed time after the water sprinkling device is deactuated.

14. The apparatus according to claim 11, further comprising:

a flow channel communicating the sterilizing water producing device with the water sprinkling device, wherein sterilizing water in the flow channel is drained from a drain hole different from the sprinkling hole after the water sprinkling device is actuated.

15. The apparatus according to claim 6, wherein a sprinkling operation of the water sprinkling device is prohibited when it is determined that the sterilizing water producing device is faulty.

16. The apparatus according to claim 15, wherein the sterilizing water producing device includes an electrolytic bath and an electrode provided inside the electrolytic bath, and it is determined that the sterilizing water producing device is faulty when voltage applied to the electrode is less than or equal to a prescribed value.

17. The apparatus according to claim 15, wherein the sterilizing water producing device includes an electrolytic bath and an electrode provided inside the electrolytic bath, and it is determined that the sterilizing water producing device is faulty when current flowing in the electrode is less than or equal to a prescribed value.

18. The apparatus according to claim 15, wherein the sterilizing water producing device includes an electrolytic bath, and it is determined that the sterilizing water producing device is faulty when flow rate of water flowing in the electrolytic bath is less than or equal to a prescribed value.

19. The apparatus according to claim 15, wherein the sterilizing water producing device includes an electrolytic bath and an electrode provided inside the electrolytic bath, and it is determined that the sterilizing water producing device is faulty when energization time of the electrode is more than or equal to a prescribed value.

20. The apparatus according to claim 19, wherein voltage applied to the electrode is increased when the energization time is less than the prescribed value and reaches another prescribed value less than and different from the prescribed value.

21. The apparatus according to claim 15, wherein the sterilizing water producing device includes an electrolytic bath, and it is determined that the sterilizing water producing device is faulty when an integrated amount of water flowing in the electrolytic bath is more than or equal to a prescribed value.

22. The apparatus according to claim 21, wherein the sterilizing water producing device further includes an electrode provided inside the electrolytic bath, and voltage applied to the electrode is increased when an integrated amount of water is less than the prescribed value and reaches another prescribed value less than and different from the prescribed value.

23. A urinal unit comprising:

a urinal; and the urinal apparatus according to claim 1.

* * * * *